US010053957B2

(12) United States Patent
Themig et al.

(10) Patent No.: US 10,053,957 B2
(45) **Date of Patent: *Aug. 21, 2018**

(54) METHOD AND APPARATUS FOR WELLBORE FLUID TREATMENT

(71) Applicant: PACKERS PLUS ENERGY SERVICES INC., Calgary (CA)

(72) Inventors: Daniel Jon Themig, Calgary (CA); Jim Fehr, Sherwood Park (CA)

(73) Assignee: Packers Plus Energy Services Inc., Calgary (CA)

( * ) Notice: Subject to any disclaimer, the term of this patent is extended or adjusted under 35 U.S.C. 154(b) by 319 days.

This patent is subject to a terminal disclaimer.

(21) Appl. No.: 14/738,506

(22) Filed: Jun. 12, 2015

(65) Prior Publication Data

US 2016/0069157 A1 Mar. 10, 2016

Related U.S. Application Data

(60) Continuation of application No. 14/150,514, filed on Jan. 8, 2014, now Pat. No. 9,074,451, which is a (Continued)

(51) Int. Cl.
*E21B 33/124* (2006.01)
*E21B 34/06* (2006.01)
(Continued)

(52) U.S. Cl.
CPC ..... *E21B 34/12* (2013.01); *E21B 33/122* (2013.01); *E21B 33/124* (2013.01);
(Continued)

(58) Field of Classification Search
CPC ..... E21B 34/14; E21B 43/14; E21B 43/25; E21B 2034/007; E21B 33/122;
(Continued)

(56) References Cited

U.S. PATENT DOCUMENTS 958,100 A 5/1910 Decker
1,510,669 A 10/1924 Halliday
(Continued)

FOREIGN PATENT DOCUMENTS

CA 2412072 A1 5/2003
CA 2838092 A1 3/2014
(Continued)

OTHER PUBLICATIONS

238th District Court, Midland, Texas, Case No. CV44964, Exhibit 10, Deposition of William Sloane Muscroft, Edmonton, Alberta, Canada, dated Mar. 31, 2007, parts 1 and 2 for a total of 111 pages.
(Continued)

*Primary Examiner* — Daniel P Stephenson
(74) *Attorney, Agent, or Firm* — Bereskin & Parr LLP/S.E.N.C.R.L., s.r.l.

(57) ABSTRACT

A tubing string assembly for fluid treatment of a wellbore includes substantially pressure holding closures spaced along the tubing string, which each close at least one port through the tubing string wall. The closures are openable by a sleeve drivable through the tubing string inner bore.

20 Claims, 6 Drawing Sheets

Related U.S. Application Data continuation of application No. 13/455,291, filed on Apr. 25, 2012, now Pat. No. 8,657,009, which is a continuation of application No. 12/830,412, filed on Jul. 5, 2010, now Pat. No. 8,167,047, which is a continuation-in-part of application No. 12/208,463, filed on Sep. 11, 2008, now Pat. No. 7,748,600, which is a continuation of application No. 11/403,957, filed on Apr. 14, 2006, now Pat. No. 7,431,091, which is a division of application No. 10/604,807, filed on Aug. 19, 2003, now Pat. No. 7,108,067.

(60) Provisional application No. 60/404,783, filed on Aug. 21, 2002.

(51) Int. Cl.

| | |
|---|---|
| ***E21B 34/10*** | (2006.01) |
| ***E21B 34/12*** | (2006.01) |
| ***E21B 43/16*** | (2006.01) |
| ***E21B 34/14*** | (2006.01) |
| ***E21B 43/14*** | (2006.01) |
| ***E21B 43/25*** | (2006.01) |
| ***E21B 33/122*** | (2006.01) |
| ***E21B 33/128*** | (2006.01) |
| *E21B 34/00* | (2006.01) |

(52) U.S. Cl.

CPC ..... *E21B 33/1285* (2013.01); *E21B 34/063* (2013.01); *E21B 34/10* (2013.01); *E21B 34/14* (2013.01); *E21B 43/14* (2013.01); *E21B 43/16* (2013.01); *E21B 43/25* (2013.01); *E21B 2034/007* (2013.01)

(58) Field of Classification Search

CPC ..... E21B 33/124; E21B 34/10; E21B 34/12; E21B 33/1285; E21B 34/063; E21B 43/16

See application file for complete search history.

(56) References Cited

U.S. PATENT DOCUMENTS

| | | | |
|---|---|---|---|
| 1,785,277 | A | 12/1930 | Mack |
| 1,956,694 | A | 5/1934 | Parrish |
| 2,121,002 | A | 6/1938 | Baker |
| 2,153,034 | A | 4/1939 | Baker |
| 2,201,299 | A | 5/1940 | Owsley et al. |
| 2,212,087 | A | 8/1940 | Thornhill |
| 2,227,539 | A | 1/1941 | Dorton |
| 2,248,511 | A | 7/1941 | Westall |
| 2,249,511 | A | 7/1941 | Westall |
| 2,287,076 | A | 6/1942 | Zachry |
| 2,330,267 | A | 9/1943 | Burt et al. |
| 2,352,700 | A | 7/1944 | Ferris |
| 2,493,650 | A | 1/1950 | Baker et al. |
| 2,537,066 | A | 1/1951 | Lewis |
| 2,593,520 | A | 4/1952 | Baker et al. |
| 2,606,616 | A | 8/1952 | Otis |
| 2,618,340 | A | 11/1952 | Lynd |
| 2,659,438 | A | 11/1953 | Schnitter |
| 2,715,444 | A | 8/1955 | Fewel |
| 2,731,827 | A | 1/1956 | Loomis |
| 2,737,244 | A | 3/1956 | Baker et al. |
| 2,752,861 | A | 7/1956 | Hill |
| 2,764,244 | A | 9/1956 | Page |
| 2,771,142 | A | 11/1956 | Sloan et al. |
| 2,780,294 | A | 2/1957 | Loomis |
| 2,807,955 | A | 10/1957 | Loomis |
| 2,836,250 | A | 5/1958 | Brown |
| 2,841,007 | A | 7/1958 | Loomis |
| 2,851,109 | A | 9/1958 | Spearow |
| 2,860,489 | A | 11/1958 | Townsend |
| 2,869,645 | A | 1/1959 | Chamberlain et al. |
| 2,945,541 | A | 7/1960 | Maly et al. |
| 2,947,363 | A | 8/1960 | Sackett et al. |
| 3,007,523 | A | 11/1961 | Vincent |
| 3,035,639 | A | 5/1962 | Brown et al. |
| 3,038,542 | A | 6/1962 | Loomis |
| 3,054,415 | A | 9/1962 | Baker et al. |
| 3,059,699 | A | 10/1962 | Brown |
| 3,062,291 | A | 11/1962 | Brown |
| 3,068,942 | A | 12/1962 | Brown |
| 3,083,771 | A | 4/1963 | Chapman |
| 3,083,775 | A | 4/1963 | Nielson et al. |
| 3,095,040 | A | 6/1963 | Bramlett |
| 3,095,926 | A | 7/1963 | Rush |
| 3,122,205 | A | 2/1964 | Brown |
| 3,148,731 | A | 9/1964 | Holden |
| 3,153,845 | A | 10/1964 | Loomis |
| 3,154,940 | A | 11/1964 | Loomis |
| 3,158,378 | A | 11/1964 | Loomis |
| 3,165,918 | A | 1/1965 | Loomis |
| 3,165,919 | A | 1/1965 | Loomis |
| 3,165,920 | A | 1/1965 | Loomis |
| 3,193,917 | A | 7/1965 | Loomis |
| 3,194,310 | A | 7/1965 | Loomis |
| 3,195,645 | A | 7/1965 | Loomis |
| 3,199,598 | A | 8/1965 | Loomis |
| 3,263,752 | A | 8/1966 | Conrad |
| 3,265,132 | A | 8/1966 | Edwards, Jr. |
| 3,270,814 | A | 9/1966 | Richardson et al. |
| 3,289,762 | A | 12/1966 | Schell et al. |
| 3,291,219 | A | 12/1966 | Nutter |
| 3,311,169 | A | 3/1967 | Hefley |
| 3,333,639 | A | 8/1967 | Page et al. |
| 3,361,209 | A | 1/1968 | Edwards, Jr. |
| 3,427,653 | A | 2/1969 | Jensen |
| 3,460,626 | A | 8/1969 | Ehrlich |
| 3,517,743 | A | 6/1970 | Pumpelly et al. |
| 3,523,580 | A | 8/1970 | Lebourg |
| 3,552,718 | A | 1/1971 | Schwegman |
| 3,587,736 | A | 6/1971 | Brown |
| 3,645,335 | A | 2/1972 | Current |
| 3,659,648 | A | 5/1972 | Cobbs |
| 3,661,207 | A | 5/1972 | Current et al. |
| 3,687,202 | A | 8/1972 | Young et al. |
| 3,730,267 | A | 5/1973 | Scott |
| 3,784,325 | A | 1/1974 | Coanda et al. |
| 3,860,068 | A | 1/1975 | Abney et al. |
| 3,948,322 | A | 4/1976 | Baker |
| 3,981,360 | A | 9/1976 | Marathe |
| 4,018,272 | A | 4/1977 | Brown et al. |
| 4,031,957 | A | 6/1977 | Sanford |
| 4,044,826 | A | 8/1977 | Crowe |
| 4,099,563 | A | 7/1978 | Hutchison |
| 4,143,712 | A | 3/1979 | James et al. |
| 4,161,216 | A | 7/1979 | Amancharia |
| 4,162,691 | A | 7/1979 | Perkins |
| 4,216,827 | A | 8/1980 | Crowe |
| 4,229,397 | A | 10/1980 | Fukuta et al. |
| 4,279,306 | A | 7/1981 | Weitz |
| 4,286,662 | A | 9/1981 | Page |
| 4,298,077 | A | 11/1981 | Emery |
| 4,299,287 | A | 11/1981 | Vann et al. |
| 4,299,397 | A | 11/1981 | Baker et al. |
| 4,315,542 | A | 2/1982 | Dockins |
| 4,324,293 | A | 4/1982 | Hushbeck |
| 4,338,999 | A | 7/1982 | Carter, Jr. |
| 4,421,165 | A | 12/1983 | Szarka |
| 4,423,777 | A | 1/1984 | Mullins et al. |
| 4,436,152 | A | 3/1984 | Fisher, Jr. et al. |
| 4,441,558 | A | 4/1984 | Welch et al. |
| 4,469,174 | A | 9/1984 | Freeman |
| 4,484,625 | A | 11/1984 | Barbee, Jr. |
| 4,494,608 | A | 1/1985 | Williams et al. |
| 4,498,536 | A | 2/1985 | Ross et al. |
| 4,499,951 | A | 2/1985 | Vann |
| 4,516,879 | A | 5/1985 | Berry et al. |
| 4,519,456 | A | 5/1985 | Cochran |
| 4,520,870 | A | 6/1985 | Pringle |
| 4,524,825 | A | 6/1985 | Fore |

(56) References Cited

U.S. PATENT DOCUMENTS 4,552,218 A 11/1985 Ross et al.
4,567,944 A 2/1986 Zunkel et al.
4,569,396 A 2/1986 Brisco
4,576,234 A 3/1986 Upchurch
4,577,702 A 3/1986 Faulkner
4,590,995 A 5/1986 Evans
4,605,062 A 8/1986 Klumpyan et al.
4,610,308 A 9/1986 Meek
4,632,193 A 12/1986 Geczy
4,637,471 A 1/1987 Soderberg
4,640,355 A 2/1987 Hong et al.
4,645,007 A 2/1987 Soderberg
4,646,829 A 3/1987 Barrington et al.
4,655,286 A 4/1987 Wood
4,657,084 A 4/1987 Evans
4,714,117 A 12/1987 Dech
4,716,967 A 1/1988 Mohaupt
4,754,812 A 7/1988 Gentry
4,791,992 A 12/1988 Greenlee et al.
4,794,989 A 1/1989 Mills
4,823,882 A 4/1989 Stokley et al.
4,880,059 A 11/1989 Brandell et al.
4,893,678 A 1/1990 Stokley et al.
4,903,777 A 2/1990 Jordan, Jr. et al.
4,907,655 A 3/1990 Hromas et al.
4,909,326 A 3/1990 Owen
4,928,772 A 5/1990 Hopmann
4,949,788 A 8/1990 Szarka et al.
4,967,841 A 11/1990 Murray
4,979,561 A 12/1990 Szarka
4,991,654 A 2/1991 Brandell et al.
5,020,600 A 6/1991 Coronado
5,048,611 A 9/1991 Cochran
5,103,901 A 4/1992 Greenlee
5,146,992 A 9/1992 Baugh
5,152,340 A 10/1992 Clark et al.
5,172,717 A 12/1992 Boyle et al.
5,174,379 A 12/1992 Whiteley et al.
5,180,015 A 1/1993 Ringgenberg et al.
5,186,258 A 2/1993 Wood et al.
5,197,543 A 3/1993 Coulter
5,197,547 A 3/1993 Morgan
5,217,067 A 6/1993 Landry et al.
5,221,267 A 6/1993 Folden
5,242,022 A 9/1993 Burton et al.
5,261,492 A 11/1993 Duell et al.
5,271,462 A 12/1993 Berzin
5,325,924 A 7/1994 Bangert et al.
5,332,038 A 7/1994 Tapp et al.
5,335,732 A 8/1994 McIntyre
5,337,808 A 8/1994 Graham
5,351,752 A 10/1994 Wood
5,355,953 A 10/1994 Shy et al.
5,375,662 A 12/1994 Echols, III et al.
5,394,941 A 3/1995 Venditto et al.
5,411,095 A 5/1995 Ehlinger et al.
5,413,180 A 5/1995 Ross et al.
5,425,423 A 6/1995 Dobson et al.
5,449,039 A 9/1995 Hartley et al.
5,454,430 A 10/1995 Kennedy et al.
5,464,062 A 11/1995 Blizzard, Jr.
5,472,048 A 12/1995 Kennedy et al.
5,479,989 A 1/1996 Shy et al.
5,499,687 A 3/1996 Lee
5,526,880 A 6/1996 Jordan, Jr. et al.
5,533,571 A 7/1996 Surjaatmadja et al.
5,533,573 A 7/1996 Jordan, Jr. et al.
5,542,473 A 8/1996 Pringle
5,558,153 A 9/1996 Holcombe et al.
5,579,844 A 12/1996 Rebardi et al.
5,609,178 A 3/1997 Hennig et al.
5,615,741 A 4/1997 Coronado
5,641,023 A 6/1997 Ross et al.
5,701,954 A 12/1997 Kilgore et al.
5,711,375 A 1/1998 Ravi et al.
5,715,891 A 2/1998 Graham et al.
5,732,776 A 3/1998 Tubel et al.
5,775,429 A 7/1998 Arizmendi et al.
5,782,303 A 7/1998 Christian
5,791,414 A 8/1998 Skinner
5,810,082 A 9/1998 Jordan, Jr.
5,826,662 A 10/1998 Beck et al.
5,865,254 A 2/1999 Huber et al.
5,894,888 A 4/1999 Wiemers et al.
5,921,318 A 7/1999 Ross
5,934,372 A 8/1999 Muth
5,941,307 A 8/1999 Tubel
5,941,308 A 8/1999 Malone et al.
5,947,198 A 9/1999 McKee et al.
5,954,133 A 9/1999 Ross
5,960,881 A 10/1999 Allamon et al.
6,003,607 A 12/1999 Hagen et al.
6,006,834 A 12/1999 Skinner
6,006,838 A 12/1999 Whiteley et al.
6,009,944 A 1/2000 Gudmestad
6,041,858 A 3/2000 Arizmendi
6,047,773 A 4/2000 Zeltman et al.
6,053,250 A 4/2000 Echols
6,059,033 A 5/2000 Ross et al.
6,065,541 A 5/2000 Allen
6,070,066 A 6/2000 Montgomery
6,079,493 A 6/2000 Longbottom et al.
6,082,458 A 7/2000 Schnatzmeyer
6,098,710 A 8/2000 Rhein-Knudsen et al.
6,109,354 A 8/2000 Ringgenberg et al.
6,112,811 A 9/2000 Kilgore et al.
6,131,663 A 10/2000 Henley et al.
6,148,915 A 11/2000 Mullen et al.
6,155,350 A 12/2000 Melenyzer
6,186,236 B1 2/2001 Cox
6,189,619 B1 2/2001 Wyatt et al.
6,220,353 B1 4/2001 Foster et al.
6,220,357 B1 4/2001 Carmichael et al.
6,220,360 B1 4/2001 Connell et al.
6,227,298 B1 5/2001 Patel
6,230,811 B1 5/2001 Ringgenberg et al.
6,241,013 B1 6/2001 Martin
6,250,392 B1 6/2001 Muth
6,253,861 B1 7/2001 Carmichael et al.
6,257,338 B1 7/2001 Kilgore
6,279,651 B1 8/2001 Schwendemann et al.
6,286,600 B1 9/2001 Hall et al.
6,302,199 B1 10/2001 Hawkins et al.
6,305,470 B1 10/2001 Woie
6,311,776 B1 11/2001 Pringle et al.
6,315,041 B1 11/2001 Carlisle et al.
6,347,668 B1 2/2002 McNeill
6,349,772 B2 2/2002 Mullen et al.
6,388,577 B1 5/2002 Carstensen
6,390,200 B1 5/2002 Allamon
6,394,184 B2 5/2002 Tolman et al.
6,446,727 B1 9/2002 Zemlak et al.
6,460,619 B1 10/2002 Braithwaite et al.
6,464,006 B2 10/2002 Womble
6,467,546 B2 10/2002 Allamon et al.
6,488,082 B2 12/2002 Echols et al.
6,491,103 B2 12/2002 Allamon et al.
6,520,255 B2 2/2003 Tolman et al.
6,543,538 B2 4/2003 Tolman et al.
6,543,543 B2 4/2003 Muth
6,543,545 B1 4/2003 Chatterji et al.
6,547,011 B2 4/2003 Kilgore
6,571,869 B1 6/2003 Pluchek et al.
6,591,915 B2 7/2003 Burris
6,634,428 B2 10/2003 Krauss et al.
6,651,743 B2 11/2003 Szarka
6,695,057 B2 2/2004 Ingram et al.
6,695,066 B2 2/2004 Allamon et al.
6,722,440 B2 4/2004 Turner et al.
6,725,934 B2 4/2004 Coronado et al.
6,752,212 B2 6/2004 Burris
6,763,885 B2 7/2004 Cavender
6,782,948 B2 8/2004 Echols et al.
6,820,697 B1 11/2004 Churchill

(56) References Cited

U.S. PATENT DOCUMENTS

| | | | |
|---|---|---|---|
| 6,883,610 | B2 | 4/2005 | Depiak |
| 6,907,936 | B2 | 6/2005 | Fehr et al. |
| 6,951,331 | B2 | 10/2005 | Haughom et al. |
| 7,021,384 | B2 | 4/2006 | Themig |
| 7,066,265 | B2 | 6/2006 | Surjaatmadja |
| 7,096,954 | B2 | 8/2006 | Weng |
| 7,108,060 | B2 | 9/2006 | Jones |
| 7,108,067 | B2 | 9/2006 | Themig et al. |
| 7,134,505 | B2 | 11/2006 | Fehr et al. |
| 7,152,678 | B2 | 12/2006 | Turner et al. |
| 7,198,110 | B2 | 4/2007 | Kilgore et al. |
| 7,231,987 | B2 | 6/2007 | Kilgore et al. |
| 7,240,733 | B2 | 7/2007 | Hayes et al. |
| 7,243,723 | B2 | 7/2007 | Surjaatmadja et al. |
| 7,267,172 | B2 | 9/2007 | Hofman |
| 7,353,878 | B2 | 4/2008 | Themig |
| 7,377,321 | B2 | 5/2008 | Rytlewski |
| 7,431,091 | B2 | 10/2008 | Themig et al. |
| 7,543,634 | B2 | 6/2009 | Fehr et al. |
| 7,571,765 | B2 | 8/2009 | Themig |
| 7,748,460 | B2 | 7/2010 | Themig et al. |
| 7,832,472 | B2 | 11/2010 | Themig |
| 7,861,774 | B2 | 1/2011 | Fehr et al. |
| 8,167,047 | B2 | 5/2012 | Themig et al. |
| 8,215,411 | B2 | 7/2012 | Flores et al. |
| 8,276,675 | B2 | 10/2012 | Williamson et al. |
| 8,281,866 | B2 | 10/2012 | Tessier et al. |
| 8,291,980 | B2 | 10/2012 | Fay |
| 8,393,392 | B2 | 3/2013 | Mytopher et al. |
| 8,397,820 | B2 | 3/2013 | Fehr et al. |
| 8,490,685 | B2 | 7/2013 | Tolman et al. |
| 8,657,009 | B2 | 2/2014 | Themig et al. |
| 8,714,272 | B2 | 5/2014 | Garcia et al. |
| 8,746,343 | B2 | 6/2014 | Fehr et al. |
| 8,757,273 | B2 | 6/2014 | Themig et al. |
| 8,978,773 | B2 | 3/2015 | Tilley |
| 8,997,849 | B2 | 4/2015 | Lea-Wilson et al. |
| 9,074,451 | B2 | 7/2015 | Themig et al. |
| 9,121,264 | B2 | 9/2015 | Tokarek |
| 2001/0009189 | A1 | 7/2001 | Brooks et al. |
| 2001/0015275 | A1 | 8/2001 | van Petegem et al. |
| 2001/0018977 | A1 | 9/2001 | Kilgore |
| 2001/0050170 | A1 | 12/2001 | Woie et al. |
| 2002/0007949 | A1 | 1/2002 | Tolman et al. |
| 2002/0020535 | A1 | 2/2002 | Johnson et al. |
| 2002/0096328 | A1 | 7/2002 | Echols et al. |
| 2002/0112857 | A1 | 8/2002 | Ohmer et al. |
| 2002/0117301 | A1 | 8/2002 | Womble |
| 2002/0162660 | A1 | 11/2002 | Depiak et al. |
| 2003/0127227 | A1 | 7/2003 | Fehr et al. |
| 2004/0000406 | A1 | 1/2004 | Allamon et al. |
| 2004/0055752 | A1 | 3/2004 | Restarick et al. |
| 2005/0061508 | A1 | 3/2005 | Surjaatmadja |
| 2006/0048950 | A1 | 3/2006 | Dybevik et al. |
| 2007/0119598 | A1 | 5/2007 | Turner et al. |
| 2007/0151734 | A1 | 7/2007 | Fehr et al. |
| 2007/0272411 | A1 | 11/2007 | Lopez De Cardenas et al. |
| 2007/0272413 | A1 | 11/2007 | Rytlewski et al. |
| 2008/0017373 | A1 | 1/2008 | Jones et al. |
| 2008/0223587 | A1 | 9/2008 | Cherewyk |
| 2009/0084553 | A1 | 4/2009 | Rytlewski et al. |
| 2010/0132959 | A1 | 6/2010 | Tinker |
| 2011/0127047 | A1 | 6/2011 | Themig et al. |
| 2011/0180274 | A1 | 7/2011 | Wang et al. |
| 2012/0067583 | A1 | 3/2012 | Zimmerman et al. |
| 2012/0085548 | A1 | 4/2012 | Fleckenstein et al. |
| 2013/0014953 | A1 | 1/2013 | van Petegem |
| 2013/0043042 | A1 | 2/2013 | Flores et al. |
| 2014/0096970 | A1 | 4/2014 | Andrew et al. |
| 2014/0116731 | A1* | 5/2014 | Themig ..... E21B 34/063 166/386 |
| 2014/0290944 | A1 | 10/2014 | Kristoffer |
| 2016/0069157 | A1* | 3/2016 | Themig ..... E21B 34/063 166/305.1 |

FOREIGN PATENT DOCUMENTS

| | | | |
|---|---|---|---|
| EP | 0094170 | A2 | 11/1983 |
| EP | 0724065 | A2 | 7/1996 |
| EP | 0802303 | A1 | 4/1997 |
| EP | 0823538 | A2 | 2/1998 |
| EP | 0950794 | A2 | 10/1999 |
| EP | 0985797 | A2 | 3/2000 |
| EP | 0985799 | A2 | 3/2000 |
| GB | 2311315 | A | 9/1997 |
| WO | WO 1997/036089 | A1 | 10/1997 |
| WO | WO 2001/006086 | A1 | 1/2001 |
| WO | WO 2001/069036 | A1 | 9/2001 |
| WO | WO 2007/017353 | A1 | 2/2007 |
| WO | WO 2009/132462 | A1 | 11/2009 |

OTHER PUBLICATIONS

238th District Court, Midland, Texas, Case No. CV44964, Exhibit 11, Email from William Sloane Muscroft to Peter Krabben dated Jan. 11, Email from William Sloane Muscroft to Peter Krabben dated Jan. 27, 2000, 1 page.

238th District Court, Midland, Texas, Case No. CV44964, Exhibit 12, Email from William Sloane Muscroft to Daniel Jon Themig dated Feb. 1, 2000, 1 page.

238th District Court, Midland, Texas, Case No. CV44964, Exhibit 13, Email from Daniel Jon Themig to William Sloane Muscroft dated Jun. 19, 2000, 2 pages.

238th District Court, Midland, Texas, Case No. CV44964, Exhibit 6, Deposition of Daniel Jon Themig, Calgary, Alberta, Canada, dated Jan. 17, 2006, parts 1 and 2 total for a total of 82 pages with redactions from p. 336, Line 10 through all of p. 337.

238th District Court, Midland, Texas, Case No. CV44964, Exhibit 7, Deposition of Daniel Jon Themig, Calgary, Alberta, Canada, dated Jan. 8, 2007, 75 pages with redactions from p. 716, Line 23 through p. 726, Line 22.

238th District Court, Midland, Texas, Case No. CV44964, Exhibit 8, Deposition of Daniel Jon Themig, Calgary, Alberta, Canada, dated Jan. 9, 2007,46 pages with redactions on p. 850, Lines 13-19.

238th District Court, Midland, Texas, Case No. CV44964, Exhibit 9, Cross-examination of Daniel Jon Themig, In the Court of Queen's Bench of Alberta, Canada, dated Mar. 14, 2005, 67 pages.

A.B. Yost et al., "Production and Stimulation Analysis of Multiple Hydraulic Fracturing of a 2,000-ft Horizontal Well," SPE-19090, 14 pages, dated 1989.

A.P. Bunger et al., "Experimental Investigation of the Interaction Among Closely Spaced Hydraulic Fractures," <https://www.onepetro.org/conference-paper/ARMA-11-318?sort=&start=0&q=review+AND+%22packers%22+AND+%22uncased+%22&from_year=2001&peer_reviewed=&published_between=on&fromSearchResults=true&to_year=&rows=50#>, ARMA-11-318, 11 pages, dated 2011.

Alfred M. Jackson et al., "Completion and Stimulation Challenges and Solutions for Extended-Reach Multizone Horizontal Wells in Carbonate Formations," <https://www.onepetro.org/conference-paper/SPE-141812-MS?sort=&start=0&q=uncased+packer&from_year=2001&peer_reviewed=&published_between=on&fromSearchResults=true&to_year=&rows=50#>, SPE-141812-MS, 11 pages, dated 2011.

Anderson, Svend Aage, et al., "Exploiting Reservoirs with Horizontal Wells: the Maersk Experience," Oilfield Review, vol. 2, No. 3, Jul. 11-21, 1990.

Angeles, et al., "One Year of Just-In-Time Perforating as Multi-Stage Fracturing Technique for Horizontal Wells," Society of Petroleum Engineers, SPE 160034, 2012; 12 pages.

Arguijo, et al., "Streamlined Completions Process: An Eagle Ford Shale Case History," Society of Petroleum Engineers, SPE 162658, 2012; 17 pages.

B.W. McDaniel et al., "Overview of Stimulation Technology for Horizontal Completions without Cemented Casing in the Lateral," SPCE-77825, pp. 1-17, dated 2002.

Backer Packers, Flow Control Systems, 2 pages, 1982-83.

(56) References Cited

OTHER PUBLICATIONS

Baihly, Jason, et al, "Sleeve Activation in Open-hole Fracturing Systems: A Ball Selection Study", Oct. 30-Nov. 1, 2012 (SPE Canadian Unconventional Resources Conference; SPE 162657), pp. 1-14, 2012.
Baker CAC, A Baker Hughes company, 1990-91 Condensed Catalog, 1990-91, 8 pages.
Baker Hughes Baker Oil Tools, Packer Systems Product Catalog, 152 pages.
Baker Hughes, "Intelligent Well Systems™," bakerhughes.com, dated Jun. 7, 2001.
Baker Hughes, Baker Oil Tools, "Cased Hole Applications," 95 pages.
Baker Hughes, Baker Oil Tools, "Open Hole Completion Systems", 3 pages, 2004.
Baker Hughes, catalog, pp. 66-73, 1991.
Baker Hughes,"Re-entry Systems Technology," <http://www.bakerhughes.com/Bot/iws/index.htm>, Dated 1999.
Baker Oil Tools Press Release, "The Edge, Electronically Enhanced Remote Autuation System," dated Jun. 10, 1996.
Baker Oil Tools product advertisements allegedly from 1948-1969, 70 pages.
Baker Oil Tools Product Announcements, "Baker Oil Tools' HCM Remote Controlled Hydraulic Sliding Sleeve,"<http://www.bakerhughes.com/Bot/Pressroom/hcm.htm>, Dated Aug. 16, 2000.
Baker Oil Tools, "Baker Oil ToolsRegion/Area Locations," 2 pages.
Baker Oil Tools, "Packer Systems", 78 pages, undated.
Baker Oil Tools, "Plugging Devices", Model 'E'™ Hydro-Trip Sub, undated, 1 page.
Baker Oil Tools, "Retrievable Packer Systems, Model 'E'™ Hydro-Trip Pressure Sub—Product No. 799-28", undated, 1 page.
Baker Oil Tools, "Retrievable Packer Systems," product brochure, 1 page, undated.
Baker Oil Tools, "Retrievable Packer Systems," product catalog, 60 pages.
Baker Oil Tools, catalog, p. 29, Model "C" Packing Element Circulating Washer, Product No. 470-42, Mar. 1997.
Baker Oil Tools, catalog, p. 38, Twin Seal Submersible Pumppacker, undated.
Baker Oil Tools, Inc., "Technical Manual: Stage Cementing Equipment—Models "J" & "JB" Stage Cementing Collars" Aug. 1, 1966, 14 pages.
Baker Oil Tools, Inflatable Systems, pp. 1-50, undated, 50 pages.
Baker Oil Tools, Inflatable Systems, pp. 1-66, undated, 66 pages.
Baker Oil Tools, New Product Fact Sheet Retrievable Packer Systems, Model "PC" Hydraulic Isolation Packer Product No. 784-07, Jun. 1988, 2 pages.
Baker Oil Tools, Packer Systems Press Release, "Edge™ Remote Actuation System Successfully Sets Packer in Deepwater Gulf of Mexico," dated Jun. 10, 1996, modified Apr. 1998.
Baker Oil Tools' Archived Product Catalogs, 963 pages.
Baker Packers Flow Control Equipment, Bulletin No. BFC-1-6/83, 142 pages.
Baker Packers, "Seating Nipples" and "Accessories for Sliding Sleeves", pp. 13, 32-33, 99, 104-107, 110, 111, 114-115, undated.
Baker Packers, "Tool Identification by Model Number" and "Accessories for Selective and Top No-Go Seating Nipples", 4 pages.
Baker Sand Control, Open Hole Gravel Packing, undated, 1 page.
Baker Service Tools, Catalog: Lynes Inflatable Products, 5 pages, undated.
Baker Service Tools, Washing Tools, 1 pages, undated.
Berryman, William, First Supplemental Expert Report in Cause No. CV-44964, 238th Judicial District of Texas, undated.
Bill Ellsworth et al., "Production Control of Horizontal Wells in a Carbonate Reef Structure," 1999 CIM Horizontal Well Conference, 10 pages.
Billy W. McDaniel "Review of Current Fracture Stimulation Techniques for Best Economics in Multi-layer, Lower Permeability Reservoirs," <https://www.onepetro.mg/conference-paper/SPE-98025-MS?sort=&start=0&q=review+horizontal+open+hole+%28uncased%29+completions+AND+%22multistage%22&from_year=2001&peer_reviewed=&published_between=on&fromSearchResults=true&to_year=2005&rows=50>, SPE-98025-MS, 19 pages, dated 2005.
BJ Services, Excape Completion Process, 12 pages,undated.
Brazil Oil & Gas, Norway Oil & Gas, 2009—Issue 10 Saudi Arabia Oil and Gas, 100 pages.
Brown Hughes, Hughes Production Tools General Catalog 1986-87, Brown Type PD 5000 Perforation Washer, 1986-87.
Brown Oil Tools General Catalog 1962-63, Hydraulic Set Packers and Hydraulic Set Retrievable Packers, pp. 870-871.
Brown Oil Tools, 1970-71 General Catalog, 3 pages, 1970-71.
Brown Oil Tools, catalog page, entitled "Brown HS-16-1 Hydraulic Set Retrievable Packers," undated.
Brown Oil Tools, catalog page, entitled "Brown Hydraulic Set Packers," undated.
Brown Oil Tools, Inc., "Brown Hydraulic Set Packers" 2 pages, undated.
Brown Oil Tools, Inc., Open Hole Packer—Long Lasting Dependability for Difficult Liner Cementing Jobs, 2 pages, undated.
Brown Oil Tools, Open Hole Packers—Long Lasting Dependability for Difficult Cementing Jobs, 1 page, undated.
"Brown Type Open Hole Packer", Brown 1986-1987 Catalog, 1 page.
C.D. Pope, et al., "Completion Techniques for Horizontal Wells in the Pearsall Austin Chalk," SPE Production Engineering, pp. 144-148, May 1992 (SPE 20682).
Canadian Sections SPE/Petroleum Society, 8th One-Day Conference on Horizontal Well Technology Schedule, Nov. 2001, 3 pages.
Canadian Sections SPE/Petroleum Society, 8th One-Day Conference on Horizontal Well Technology, Abstract: Open Hole Stimulation and Testing Carbonate Reservoirs, Nov. 2001, 1 page.
Canadian Sections SPE/Petroleum Society, 8th One-Day Conference on Horizontal Well Technology, Abstract: Successfule Open Hole Water Shut-Offs in Deep Hot Horizontal Wells, Nov. 2001, 1 page.
Canadian Sections SPE/Petroleum Society, 8th One-Day Conference on Horizontal Well Technology, Online Library Catalog Listing, Nov. 2001, 2 pages.
Canning, et al., "Innovative Pressure-Actuated Toe Sleeve Enables True Casing Pressure Integrity Test and Stage Fracturing While Improving Completion Economics in Unconventional Resources," Society of Petroleum Engineers, SPE 167170, 2013; 7 pages.
Carpenter, C., "Technology Applications," Journal of Petroleum Technology, accessible at http://www.spe.org/jpt/article/8570-technology-applications-33/, undated; 13 pages.
Chambers, M.R., et al, "Well Completion Design and Operations for a Deep Horizontal Well with Multiple Fractures", 1995 (SPE 30417), pp. 499-505.
Chauffe, S., "Hydraulic to Valve Specifically Designed for a Cemented Environment," AADE-13-FTCE-25, American Association of Drilling Engineers, 2013; 5 pages.
Composite Catalog of Oil Field Equipment and Services, Lynes Cement Collar, p. 18, 1980-81, 2 pages.
Composite Catalog of Oil Field Equipment Services, Baker Sand Control, Open Hole Gravel Packing, p. 870, 1980-81, 2 pages.
Conn, et al, "A Common Sense Approach to Intelligent Completions Through Improved Reliability and Lower Costs", Technical Publication, PROMORE 002, Nov. 2001, 7 pages.
Conn, T., "The Need for Intelligent Completions in Land-Based Well", PROMORE Engineering Inc, 2001, 8 pages.
Conn, Tim, "Get Smart, New Monitoring System Improves Understanding of Reservoirs", New Technology Magazine, Jan./Feb. 2001.
Coon, Robert et al., "Single-Trip Completion Concept Replaces Multiple Packers and Sliding Sleeves in Selection Multi-Zone Production and Stimulation Operations," Society of Petroleum Engineers, SPE-29539, pp. 911-915, dated 1995.
Crawford, M., "Fracturing Gas-Bearing Strata," Well Servicing Magazine, Nov.-Dec. 2009; 3 pages.
D.L. Purvis et al., "Alternative Method for Stimulating Open Hole Horizontal Wellbores," SPE-55614, pp. 1-13, dated 1999.
D.W. Thomson et al., "Design and Installation of a Cost-Effective Completion System for Horizontal Chalk Wells Where Multiple

(56) References Cited

OTHER PUBLICATIONS

Zones Require Acid Stimulation," Offshore Technology Conference, OTC 8472, pp. 323-335, dated May 1997.
D.W. Thomson et al., "Design and Installation of a Cost-Effective Completion System for Horizontal Chalk Wells Where Multiple Zones Require Acid Stimulation," Society of Petroleum Engineers, SPE 37482, pp. 97-108, dated 1997.
D.W. Thomson et al., "Design and Installation of a Cost-Effective Completion System for Horizontal Chalk Wells Where Multiple Zones Require Acid Stimulation," SPE Drilling & Completion, SPE 51177, pp. 151-156, Sep. 1998, disclosed at SPE Production Operations Symposium, Mar. 9-11, 1997, Oklahoma City, Oklahoma.
Damgaard, A.P. et al., "A Unique Method for Perforating, Fracturing, and Completing Horizontal Wells," SPE Production Engineering, Feb. 1992, (SPE-19282), pp. 61-69.
Daniel Savulescu, "Inflatable Casing Packers—Expanding the limits," Journal of Canadian Petroleum Technology, vol. 36, No. 9, pp. 9-10, dated Oct. 1997.
Defendants' Invalidity Contentions, *Rapid Completions LLC* v. *Baker Hughes Incorporated, et al.*, v. *Packers Plus Energy Services, Inc., et al.*, Case No. 6:15-cv-00724-RWS-KNM (E.D. Texas); 84 pages.
Denney, D., "Technology Applications," Journal of Petroleum Technology, accessible at http://www.spe.org/jpt/article/198-technology-applications-2012-04/, Apr. 2012; 10 pages.
Denney, D., "Technology Applications," Journal of Petroleum Technology, accessible at http://www.spe.org/jpt/m/article/450-technology-applications-august-2012, Aug. 2012; 4 pages.
Donald S. Dreesen et al., "Developing Hot Dry Rock Reservoirs with Inflatable Open Hole Packers," LA-UR-87-2083, 9 pages, dated 1987.
Donald S. Dreesen et al., "Open Hole Packer for High Pressure Service in a Five Hundred Degree Fahrenheit Precambrian Wellbore," LA-UR-85-42332, SPE-14745, 14 pages, dated 1985.
Doug G. Durst et al. "Advanced Open Hole Multilaterals," <https://www.onepetro.org/conference-paper/SPE-77199-MS?sort=&start=0&q=review+AND+%22packers%22+AND+%22open+hole%22&from_year=2001&peer_reviewed=&published_between=on&fromSearchResults=true&to_year=&rows=50#>, SPE-77199-MS, pp. 1-8, dated 2002.
Drawings, Packer Installation Plan, PACK 05543, 5 pages, 1997.
Dresser Oil Tools, catalog, Multilateral Completion Tools Section, undated.
Dresser Oil Tools, catalog, Technical Section, title page and p. 18, Nov. 1997.
Dresser Oil Tools, Multilateral and Horizontal Completions—Zonemaster Reservoir Access Mandrels, "The Zonemaster Reservoir Access Mandrel offers a long term performance alternative to the use of sliding sleeves in Horizontal wells." undated, 2 pages.
European Search Report, European Appl. No. 10836870.5, EPO, 11 pages, dated Nov. 21, 2015.
Exxon Mobil, "Tight Gas: New Technologies, New Solutions," ExxonMobil, May 2010; 2 pages.
F.M. Verga et al., "Advanced Well Simulation in a Multilayered Reservoir," <https://www.onepetro.org/conference-paper/SPE-68821-MS?sort=&start=250&q=review+horizontal+open+hole+%28uncased%29+completions+AND+%22multi%22&from_year=&peer_reviewed=&published_between=on&fromSearchResults=true&to_year=2001&rows=50#>, SPE-68821-MS, 10 pages, dated 2001.
Federal Court of Calgary, Alberta Canada, Court File No. T-1202-13, Further Amended Statement of Defence and Counterclaim to Amended Statement of Claim, dated May 13, 2014, 24 pages.
Federal Court of Calgary, Alberta Canada, Court File No. T-1728-15, Statement of Defence and Counterclaim to Amended Statement of Claim, dated Feb. 1, 2016, 24 pages.
Federal Court of Toronto, Ontario Canada, Court File No. T-1202-13, Fresh As Amended Counterclaim of TMK Completions Ltd. and Perelam, LLC., dated Jul. 13, 2015, 15 pages.
Federal Court of Toronto, Ontario Canada, Court File No. T-1741-13, Statement of Defence and Counterclaim, dated Nov. 22, 2013, 11 pages.
First Supplemental Expert Report of Kevin Trahan, Case No. CV-44,964, 238th Judicial District, Midland County, Texas, Aug. 21, 2008, 28 pages.
Fishing Services, Baker Oil Tools, 2001 Catalog.
Fishing Services, Baker Oil Tools, undated catalog.
Garfield, et al., "Novel Completion Technology Eliminates Formation Damage and Reduces Rig Time in Sand Control Applications," Society of Petroleum Engineers, SPE 93518, 2005; 5 pages.
George Everette King, "60 Years of Multi-Fractured Vertical, Deviated and Horizontal Wells: What Have We Learned?," <https://www.onepetro.org/conference-paper/SPE-170952-MS?sort=&start=100&q=review+AND+%22packers%22+AND+%22open+hole%22&from_year=2014&peer_reviewed=&published_between=on&fromSearchResults=true&to_year=&rows=100#>, SPE-170952-MS, 32 pages, dated 2014.
Guiberson AVA—Dresser Oil Tools, "Technical Section—Advanced Horizontal and Multilateral Completions", Nov. 1997, 36 pages.
Guiberson AVA & Dresser, Retrievable Packer Systems, "Tandem Packer (Wizard I)", p. 32, undated.
Guiberson AVA & Dresser, "Hydraulic Set Packer: G-77 Packer," p. 20, undated.
Guiberson AVA, Dresser Oil Tools, "Tech Manual: Wizard II Hydraulic Set Retrievable Packer," Apr. 1998, 42 pages.
Guiberson AVA, Packer Installation Plan, 5 pages, Nov. 11, 1997.
Guiberson AVA, Packer Installation Plan, Aug. 26, 1997.
Guiberson AVA, Packer Installation Plan, Sep. 9, 1997.
Guiberson AVA, Wizard II Hydraulic Set Retrievable Packer Tech Manual, Apr. 1998.
Guiberson-AVA Dresser, catalog, front page and pp. 1 & 20, 1994.
Halliburton "Halliburton Guiberson® G-77 Hydraulic-Set Retrievable Packer," 6 pages, undated.
Halliburton Oilwell Cementing Company, Fracturing Services, 1956 catalog, 6 pages.
Halliburton Oilwell Cementing Company, Improved Services for Increasing Production, 1956 catalog, 3 pages.
Halliburton Retrievable Service Tools, product brochure, 15 pages, undated.
Halliburton Services, 1970-71 Sales and Service Catalog, pp. 2335, 2338, 2340, and 2341, 6 pages.
Halliburton Services, 1970-71 Sales and Service Catalog, pp. 2434-2435, 3 pages.
Halliburton, Plaintiffs Fourth Amended Petition in Cause No. CV-44964, 238th Judicial District of Texas, Aug. 13, 2007.
Halliburton, catalog, pp. 51-54, 1957.
Halliburton, "Casing Sales Manual: Multiple-Stage Fracturing," Jul. 2003, 10 pages.
Halliburton, "Full-Opening (FO) Multiple-Stage Cementer," p. 12, 2001, 2 pages.
Halliburton, "Hydraulic-Set Guiberson™ Wizard Packer®," 1 page, undated.
Halliburton, "Unlock the Trapped Potential of Your High Perm Reservoir," <http://www.halliburton.com/products/prod_enhan/f-333511m> halliburton.com, dated Feb. 26, 2000.
Halliburton, "Zonemaster Reservoir Access Mandrel System", undated.
Halliburton, Completion Products, p. 2-25, 1999 3 pages.
Halliburton, Multiple-Stage Fracturing, pp. 9-1 and 9-2, 2013.
Hansen, J. H. et al., "Controlled Acid Jet (CAJ) Technique for Effective Single Operation Stimulation of 14,000+ ft Long Reservoir Sections," Society of Petroleum Engineers Inc., SPE 78318, Oct. 2002, 11 pages.
Henderson, R., "Open Hole Completion Systems," Presentation, Kentucky Oil & Gas Association, 2014; 33 pages.
Henry Restarick, "Horizontal Completion Options in Reservoirs with Sand Problems," SPE-29831, pp. 545-560, dated 1995.
Hodges, Steven, et al, "Hydraulically-Actuated Intelligent Completions: Development and Applications", (OTC-11933-MS) May 2000, 16 pages.

(56) References Cited

OTHER PUBLICATIONS

Horizontal Completion Problems, Baker Hughes Solutions, 1996, 6 pages.
I.B. Ishak et al., "Review of Horizontal Drilling", <https://www.onepetro.org/conference-paper/SPE-29812-MS?sort=&start=0 &q=review+horizontal+open+hole+%28uncased%29+ completions+AND+%22multi%22&from_year=&peer_reviewed= &published_between=on&fromSearchResults=true&to_year=2001 &rows=50#>, SPE-29812-MS, pp. 391-404, dated 1995.
Ismail Gamal et al., "Ten Years Experience in Horizontal Application & Pushing the Limits of Well Construction Approach in Upper Zakum Field (Offshore Abu Dhabi)," <https://www.onepetro.org/conference-paper/SPE-87284-MS?sort=&start=150 &q=review+horizontal+open+hole+%28uncased%29+ completions+AND+%22multi%22&from_year=&peer_reviewed= &published_between=on&fromSearchResults=true&to_year=2001 &rows=50#>, SPE-87284-MS, 17 pages, dated 2000.
J.C. Zimmerman et al., "Selection of Tools for Stimulation in Horizontal Cased Hole," SPE-18995, 12 pages, dated 1989.
J.E. Brown et al., "An Analysis of Hydraulically Fractured Horizontal Wells," SPE-24322, dated 1992.
Jesse J. Constantine, "Selective Production of Horizontal Openhole Completions Using ECP and Sliding Sleeve Technology," SPE-55618, pp. 1-5, dated 1999.
John B. Weirich et al., "Frac-Packing: Best Practices and Lessons Learned from over 600 Operations," <https://www.onepetro.org/conference-paper/SPE-147419-MS?sort=&start=0 &q=%22packers%22+AND+%22open+hole%22+AND+%22 review%22+AND+%22advanced%22&from_year=2010&peer_ reviewed=&published_between=on&fromSearchResults=true &to_year=&rows=100#>, SPE-147419-MS, 17 pages, dated 2012.
John H. Healy et al., "Hydraulic Fracturing in Situ Stress Measurements to 2.1 KM Depth at Cajon Pass, California," Geophysical Research Letters, vol. 15, No. 9, pp. 1005-1008, dated 1988.
Johnny Bardsen et al. "Improved Zonal Isolation in Open Hole Applications," <https://www.onepetro.org/conference-paper/SPE-169190-MS?sort=&start=0 &q=review+AND+%22packers%22+AND+%22open+hole%22 &from_year=2001&peer_reviewed=&published_between=on &fromSearchResuts=true&to_year=&rows=50#>, SPE-169190-MS, 10 pages, dated 2014.
Jul. 23, 2008 Declaration of Daniel J. Themig, U.S. Appl. No. 12/058,337, filed Aug. 1, 2008.
Kamphuis, H., et al, "Multiple Fracture Stimulations in Horizontal Open-Hole Wells the Example of Well Boetersen Z9," Germany, 1998 (SPE 50609), pp. 351-360.
Kogsball, Hans-Henrik, et al., Ceramic screens control proppant flowback in fracture-stimulated offshore wells, Aug. 2011, pp. 43-50.
Koloy, et al., "The Evolution, Optimization & Experience of Multistage Frac Completions in a North Sea Environment," Society of Petroleum Engineers, SPE-170641-MS, 2014; 15 pages.
Koshtorev, pp. 14-15, 1987, 2 pages.
Lagone, K.W. et al., SPE-530-PA—"A New Development in Completion Methods—The Limited Entry Technique," Shell Oil Co., Jul. 1963, pp. 695-702.
Larsen, Frank P., et al., "Using 4000 ft Long Induced Fractures to Water Flood the Dan Field," Sep. 1997 (SPE 38558), pp. 583-593.
Leonard John Kalfayan, "The Art and Practice of Acid Placement and Diversion: History, Present State, and Future," <https://www.onepetro.org/conference-paper/SPE-124141-MS?sort=&start=0 &q=%22horizontal+chalk+wells%22+AND+%22review%22+ &from_year=&peer_reviewed=&published_between= &fromSearchResults=true&to_year=&rows=50#>, 124141-MS SPE Conference Paper, pp. 1-17, dated 2009.
Lohoefer, et al., "New Barnett Shale Horizontal Completion Lowers Cost and Improves Efficiency," Society of Petroleum Engineers, SPE 103046, 2006; 9 pages.
Lynes ECPs and Cementing Tools, Baker catalog, pp. 89 and 87, dated 1988, 5 pages.
M.C. Vincent, "Proving It—A Review of 80 Published Field Studies Demonstrating the Importance of Increased Fracture Conductivity", <https://www.onepetro.org/conference-paper/SPE-77675-MS?sort=&start=0 &q=horizontal+open+hole+uncased+completions+AND+%22 multistage%22&from_year=2001&peer_reviewed= &published_between=on&fromSearchResults=true&to_year=2005 &rows=50#>, SPE-77675-MS, pp. 1-21, dated 2002.
M.R. Norris et al., "Hydraulic Fracturing for Reservoir Management: Production Enhancement, Scale Control and Asphaltine Prevention," >https://www.onepetro.org/conference-paper/SPE-71655-MS?sort=&start=350 &q=review+horizontal+open+hole+%28uncased%29+ completions+AND+%22multi%22&from_year= &peer_reviewed=published_between=on &fromSearchResults=true&to_year=2001&rows=50#>, SPE-71655-MS, 12 pp., dated 2001.
Maddox, et al., "Cementless Multi-Zone Horizontal Completion Yields Three-Fold Increase," IADC/SPE Drilling Conference, IADC/SPE 112774, 2008; 7 pages.
Martin P. Coronado et al., "Advanced Openhole Completions Utilizing a Simplified Zone Isolation System," SPE 77438, pp. 1-11, Dated 2002.
Martin P. Coronado et al., "Development of a One-trip ECP Cement Inflation and Stage Cementing System for Open Hole Completions," IADC/SPE-39345, pp. 473-481, dated 1998.
Martin, A.N., "Innovative Acid Fracturing Operations Used to Successfully Simulate Central North Sea Reservoir," SPE 36620, pp. 479-486, dated 1996.
Mascara, S., et al, "Acidizing Deep Open-Hole Horizontal Wells: A case History on Selective Stimulation and Coil Tubing Deployed Jetting System," 1999 (SPE 54738) 11 pages.
Mathur, et al., "Contrast Between Plug and Perf Method and Ball and Sleeve Method for Horizontal Well Stimulation," Sep. 14, 2013; 12 pages.
Mazerov, Katie, "Innovative Systems Enhance Ability to Achieve Selective Isolated Production in Horizontal Wells", Drilling Contractor, May/Jun. 2008, pp. 124-129.
McDaniel, B.W., et al, "Limited-Entry Frac Applications on Long Intervals of Highly Deviated or Horizontal Wells", 1999, pp. 1-12 (SPE 56780).
Mitchell, et al., "First Successful Application of Horizontal Open Hole Multistage Completion Systems in Turkey's Selmo Field," Society of Petroleum Engineers, SPE-17077-MS, 2014; 9 pages.
Morali, Shirali C., An Innovative Single-Completion Design With Y-Block and ESP for Multiple Reservoirs, May 1990 (SPE-17663-PA) pp. 113-119.
Neftyanoe, Hozyaistvo, p. 42, 1993, 1 page.
Neftyanoe, Hozyaistvo, pp. 40-41, 1993, 2 pages.
Offshore Magazine "One Trip Completion Method," dated Jul. 2001.
Olivier Lietard et al., "Hydraulic Fracturing of Horizontal Wells: An Update of Design and Execution Guidelines," <https://www.onepetro.org/conference-paper/SPE-37122-MS?sort=&start=0 &q=review+horizontal+open+hole+%28uncased%29+ completions+AND+%22multistage%22&from_year= &peer_reviewed=published_between=on &fromSearchResults=true&to_year=2001&rows=50#>, SPE-37122-MS, pp. 723-737, dated 1996.
Order of Dismissal, Case No. CV-44,964, 238th Judicial District, Midland County, Texas, Oct. 14, 2008, 1 page.
Osisanya S. et al., "Design Criteria and Selection of Downhole Tools for Conducting Interference Tests in Horizontal Wells" SPE/CIM/CANMET International Conference on Recent Advances in Horizontal Well Applications, Mar. 20-23, 1994, Calgary, Canada, Paper No. HWC-94-58.
Otis Pumpdown Equipment and Services, OTIS Pumpdown Flow Control Equipment, Production Maintenance Utilizing Pumpdown Tools, OTIS Pumpdown Completion Equipment, 1974-75 Catalog.
Owen Oil Tools Mechanical Gun Release; 2⅜" & 2⅞" product description, 1 page, undated.
P. D. Ellis et al., "Application of Hydraulic Fractures in Openhole Horizontal Wells," SPE-65464, 10 pages, dated 2000.
Packers Plus, Second Amended Original Answer in Cause No. CV-44964, 238th Judicial District of Texas, Feb. 13, 2007.

(56) References Cited

OTHER PUBLICATIONS

Packers Plus—New Technology, "RockSeal Open Hole Packers Series", Dec. 21, 2005.
Packers Plus Energy Services Homepage, "Welcome to Packers Plus," <http://packersplus.com/index.htm>, dated Feb. 23, 2000.
Packers Plus Energy Services, Inc. "5.1 RockSeal™ II Open Hole Packer Series," <http://www.packersplus.com/rockseal%202.htm>, 2 pgs., dated 2004, available prior to Nov. 19, 2001.
Packers Plus Press Release, "Ken Paltzat Canadian Operations Manager for Packers Plus," Dated Feb. 1, 2000.
Packers Plus, Original Answer in Cause No. CV-44964, 238th Judicial District of Texas, Feb. 13, 2007.
Paolo Gavioli et al., "The Evolution of the Role of Openhole Packers in Advanced Horizontal Completions: From Optional Accessory to Critical Key of Success," <https://www.onepetro.org/conference-paper/SPE-132846-MS?sort=&start=0 &q=%22packers%22+AND+%22open+hole%22+AND+%22 review%22+AND+%22advanced%22&from_year=2010&peer_ reviewed=&published_between=on&fromSearchResults=true &to_year=&rows=100#>, SPE-132846-PA, pp. 1-27, dated 2010.
PetroQuip Energy Services, BigFoot PetroQuip Case Study, Dec. 22, 2015; 1 page.
PetroQuip Energy Services, BigFoot Production Description, accessible at http://www.petroquip.com/index.php/2012-10-22-19-46-41/land-completions/big-foot, undated; 2 pages.
PetroQuip Energy Services, BigFoot Toe Sleeve PetroQuip Case Study, Nov. 2014; 2 pages.
Petro-Tech Tools, Inc., Dump Circulating Sub, Jul. 2, 1996, 3 pages.
Polar Completions Engineering Inc. Technical Manual, Jul. 5, 2001, Rev. 2, 13 pages.
Polar Completions Engineering, Bearfoot Packer 652-0000, 5 pages, Jul. 5, 2001.
R. Seale et al. "An Effective Horizontal Well Completion and Stimulation System," Journal of Canadian Petroleum Technology, vol. 46, No. 12, pp. 73-77, dated Dec. 2007.
R.J. Tailby et al., "A New Technique for Servicing Horizontal Wells," SPE-22823, pp. 43-58, Dated 1991.
Ricky Plauche and W. E. (Skip) Koshak, "Advances in Sliding Sleeve Technology and Coiled Tubing Performance Enhance Multizone Completion of Abnormally Pressured Gulf of Mexico Horizontal Well," ICoTA, Apr. 1997 (SPE 38403).
Rockey Seale et al., "Effective Simulation of Horizontal Wells—A New Completion Method," SPE-106357, 5 pages, dated 2006.
Ross, Elsie, "New Monitoring System Improves Understanding of Reservoirs", New Tech Magazine Jan. 2001.
Rune Freyer, "Swelling Packer for Zonal Isolation in Open Hole Screen Completions," SPE-78312, pp. 1-5, dated 2002.
Ryan Henderson, "Open Hole Completion Systems," Tennessee Oil and Gas Association, dated 2014.
S. Mascarà, et al., "Acidizing Deep Open-Hole Horizontal Wells: A case History on Selective Stimulation and Coil Tubing Deployed Jetting System," SPE-54738, pp. 1-11, dated 1999.
Sapex Oil Tools Ltd. Downhole Completions catalog, 24 pages, undated.
Seale, Rocky, "Open-Hole completions System Enables Multi-Stage Fracturing and Stimulation Along Horizontal Wellbores", Drilling Contractor, Jul./Aug. 2007, pp. 112-114.
Suresh Jacob et al. "Advanced Well Completion Designs to Meet Unique Reservoir and Production Requirements," <https://www.onepetro.org/conference-paper/SPE-172215-MS?sort=&start=0 &q=review+AND+%22packers%22+AND+%22open+hole%22 &from_year=2014&peer_reviewed=&published_between=on &fromSearchResults=true&to_year=rows=100#>, SPE-172215-MS, pp. 1-13, dated 2014.
T.P. Frick "State-Of-The-Art in the Matrix Stimulation of Horizontal Wells," <https://www.onepetro.org/journal-paper/SPE-26997-PA?sort=&start=0 &q=horizontal+open+hole+uncased+completions+AND+%22 multistage%22&from_year=&peer_reviewed= &published_between=on&fromSearchResults=true&to_year=2001 &rows=50#>, SPE-26997-PA, pp. 94-102, dated May 1996.
TAM Inflatable Zone Insolation Systems, TAM catalog, p. 5, dated 1994, 1 page.
Tam International, "Inflatable Bridge Plugs and Cement Retainers," <http://tamintl.com/pages/plugg.htm>, Dated Oct. 22, 2000.
TAM Int'l, Inc., TAM Casing Annulus Packers and Accessories, pp. 14-15, 1994, 4 pages.
TAM Int'l, Inc., TAM Casing Annulus Packers and Accessories, pp. 4-5, 1994, 4 pages.
Team Oil, "Multi-Stage Fracturing—Orio Toe Valve," TEAM Oil Tools, accessible at http://www.teamoiltools.com/ProductServices/Multistage-Fracturing-ORIO-Toe-Valve/, undated; 1 page.
Thomas Finkbeiner, "Reservoir Optimized Fracturing—Higher Productivity From Low-Permeability Reservoirs Through Customized Multistage Fracturing," Society of Petroleum Engineers, SPE-141371, pp. 1-16, dated 2011.
Top Tool Company, Hydraulic Perforation Wash Tool, 4 pages, undated.
Trahan, Kevin, Affidavit Exhibit C, May 19, 2008.
Trahan, Kevin, Affidavit Exhibit E, May 19, 2008.
Trahan, Kevin, Affidavit Exhibit G, May 19, 2008.
Trahan, Kevin, Affidavit, May 19, 2008.
Van Domelen, M.S., "Enhanced Profitability with Non-Conventional IOR Technology," Oct. 1998 (SPE 49523), pp. 599-609.
White, Cameron, "Formation Characteristics dictate Completion Design", Oil & Gas Journal, pp. 31-36, 1991.
Wong, F.Y. et al., "Developing a Field Strategy to Eliminate Crossflow Along a Horizontal Well," SPE/CIM/CANMET International Conference on Recent Advances in Horizontal Well Applications, Mar. 20-23, 1994, Calgary, Canada, Paper No. HWC-94-24.
Yakovenko, et al, "Tests Results of the New Device for Open Bottom Hole Wells Cementing Operations," May 2001, 3 pages.
Yuan, et al., "Improved Efficiency of Multi-Stage Fracturing Operations: An Innovative Pressure Activated Toe Sleeve," Society of Petroleum Engineers, SPE-172971-MS, 2015; 6 pages.
Yuan, et al., "Unlimited Multistage Frac Completion System: A Revolutionary Ball-Activated System with Single Size Balls," Society of Petroleum Engineers, SPE 166303, 2013; 9 pages.
Information on RockSeal Open Hole Packers, these or similar packers believed to be publicly available in the US prior to Aug. 19, 2002.

* cited by examiner

METHOD AND APPARATUS FOR WELLBORE FLUID TREATMENT

CROSS REFERENCE TO RELATED APPLICATIONS

This application is a continuation application of U.S. Ser. No. 14/150,514 filed Jan. 8, 2014. U.S. Ser. No. 14/150,514 is a continuation application of Ser. No. 13/455,291 filed Apr. 25, 2012, now U.S. Pat. No. 8,657,009 issued Feb. 25, 2014 which is a continuation application of Ser. No. 12/830,412 filed Jul. 5, 2010, now U.S. Pat. No. 8,167,047 issued May 1, 2012, which is a continuation-in-part application of Ser. No. 12/208,463, filed Sep. 11, 2008, now U.S. Pat. No. 7,748,460 issued Jul. 6, 2010, which is a continuation of U.S. application Ser. No. 11/403,957 filed Apr. 14, 2006, now U.S. Pat. No. 7,431,091, issued Oct. 7, 2008, which is a divisional application of U.S. application Ser. No. 10/604,807 filed Aug. 19, 2003, now U.S. Pat. No. 7,108,067, issued Sep. 19, 2006. This application also claims priority through the above-noted applications to U.S. provisional application Ser. No. 60/404,783 filed Aug. 21, 2002.

FIELD OF THE INVENTION

The invention relates to a method and apparatus for wellbore fluid treatment and, in particular, to a method and apparatus for selective flow control to a wellbore for fluid treatment.

BACKGROUND OF THE INVENTION

An oil or gas well relies on inflow of petroleum products. When drilling an oil or gas well, an operator may decide to leave productive intervals uncased (open hole) to expose porosity and permit unrestricted wellbore inflow of petroleum products. Alternately, the hole may be cased with a liner, which is then perforated to permit inflow through the openings created by perforating.

When natural inflow from the well is not economical, the well may require wellbore treatment termed stimulation. This is accomplished by pumping stimulation fluids such as fracturing fluids, acid, cleaning chemicals and/or proppant laden fluids to improve wellbore inflow.

In one previous method, the well is isolated in segments and each segment is individually treated so that concentrated and controlled fluid treatment can be provided along the wellbore. Often, in this method a tubing string is used with inflatable element packers thereabout which provide for segment isolation. The packers, which are inflated with pressure using a bladder, are used to isolate segments of the well and the tubing is used to convey treatment fluids to the isolated segment. Such inflatable packers may be limited with respect to pressure capabilities as well as durability under high pressure conditions. Generally, the packers are run for a wellbore treatment, but must be moved after each treatment if it is desired to isolate other segments of the well for treatment. This process can be expensive and time consuming. Furthermore, it may require stimulation pumping equipment to be at the well site for long periods of time or for multiple visits. This method can be very time consuming and costly.

Other procedures for stimulation treatments use tubing strings without packers such that tubing is used to convey treatment fluids to the wellbore, the fluid being circulated up hole through the annulus between the tubing and the wellbore wall or casing.

The tubing string, which conveys the treatment fluid, can include ports or openings for the fluid to pass therethrough into the borehole. Where more concentrated fluid treatment is desired in one position along the wellbore, a small number of larger ports are used. In another method, where it is desired to distribute treatment fluids over a greater area, a perforated tubing string is used having a plurality of spaced apart perforations through its wall. The perforations can be distributed along the length of the tube or only at selected segments. The open area of each perforation can be preselected to control the volume of fluid passing from the tube during use. When fluids are pumped into the liner, a pressure drop is created across the sized ports. The pressure drop causes approximate equal volumes of fluid to exit each port in order to distribute stimulation fluids to desired segments of the well.

In many previous systems, it is necessary to run the tubing string into the bore hole with the ports or perforations already opened. This is especially true where a distributed application of treatment fluid is desired such that a plurality of ports or perforations must be open at the same time for passage therethrough of fluid. This need to run in a tube already including open perforations can hinder the running operation and limit usefulness of the tubing string.

Some sleeve systems have been proposed for flow control through tubing ports. However, the ports are generally closely positioned such that they can all be covered by the sleeve.

SUMMARY OF THE INVENTION

A method and apparatus has been invented which provides for selective communication to a wellbore for fluid treatment. In one aspect, the method and apparatus provide for the running in of a fluid treatment string, the fluid treatment string having ports substantially closed against the passage of fluid therethrough, but which are openable when desired to permit fluid flow into the wellbore. The apparatus and methods of the present invention can be used in various borehole conditions including open holes, lined or cased holes, vertical, inclined or horizontal holes, and straight or deviated holes.

In one embodiment, there is provided an apparatus for fluid treatment of a borehole, the apparatus comprising a tubing string having a long axis, a plurality of closures accessible from the inner diameter of the tubing string, each closure closing a port opened through the wall of the tubing string and preventing fluid flow through its port, but being openable to permit fluid flow through its port and each closure openable independently from each other closure and a port opening sleeve positioned in the tubing string and driveable through the tubing string to actuate the plurality of closures to open the ports.

The sleeve can be driven in any way to move through the tubing string to actuate the plurality of closures. In one embodiment, the sleeve is driveable remotely, without the need to trip a work string such as a tubing string, coiled tubing or a wire line.

In one embodiment, the sleeve has formed thereon a seat and the apparatus includes a sealing device selected to seal against the seat, such that fluid pressure can be applied to drive the sleeve and the sealing device can seal against fluid passage past the sleeve. The sealing device can be, for example, a plug or a ball, which can be deployed without connection to surface. This embodiment avoids the need for tripping in a work string for manipulation.

In one embodiment, the closures each include a cap mounted over its port and extending into the tubing string inner bore, the cap being openable by the sleeve engaging against. The cap, when opened, permits fluid flow through the port. The cap can be opened, for example, by action of the sleeve breaking open the cap or shearing the cap from its position over the port.

In another embodiment, the closures each include a port-closure sleeve mounted over at least one port and openable by the sleeve engaging and moving the port-closure sleeve away from its associated at least one port. The port-closure sleeve can include, for example, a profile on its surface open to the tubing string and the port-opening sleeve includes a locking dog biased outwardly therefrom and selected to engage the profile on the port-closure sleeve such that the port-closure sleeve is moved by the port opening sleeve. The profile is formed such that the locking dog can disengage therefrom, permitting the sleeve to move along the tubing string to a next port-closure sleeve.

In one embodiment, the apparatus can include a packer about the tubing string. The packers can be of any desired type to seal between the wellbore and the tubing string. For example, the packer can be a solid body packer including multiple packing elements.

In view of the foregoing there is provided a method for fluid treatment of a borehole, the method comprising: providing an apparatus for wellbore treatment according to one of the various embodiments of the invention; running the tubing string into a wellbore to a position for treating the wellbore; moving the sleeve to open the closures of the ports and increasing fluid pressure to force wellbore treatment fluid out through the ports.

In one method according to the present invention, the fluid treatment is a borehole stimulation using stimulation fluids such as one or more of acid, gelled acid, gelled water, gelled oil, $CO_2$, nitrogen and any of these fluids containing proppants, such as for example, sand or bauxite. The method can be conducted in an open hole or in a cased hole. In a cased hole, the casing may have to be perforated prior to running the tubing string into the wellbore, in order to provide access to the formation.

The method can include setting a packer about the tubing string to isolate the fluid treatment to a selected section of the wellbore.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
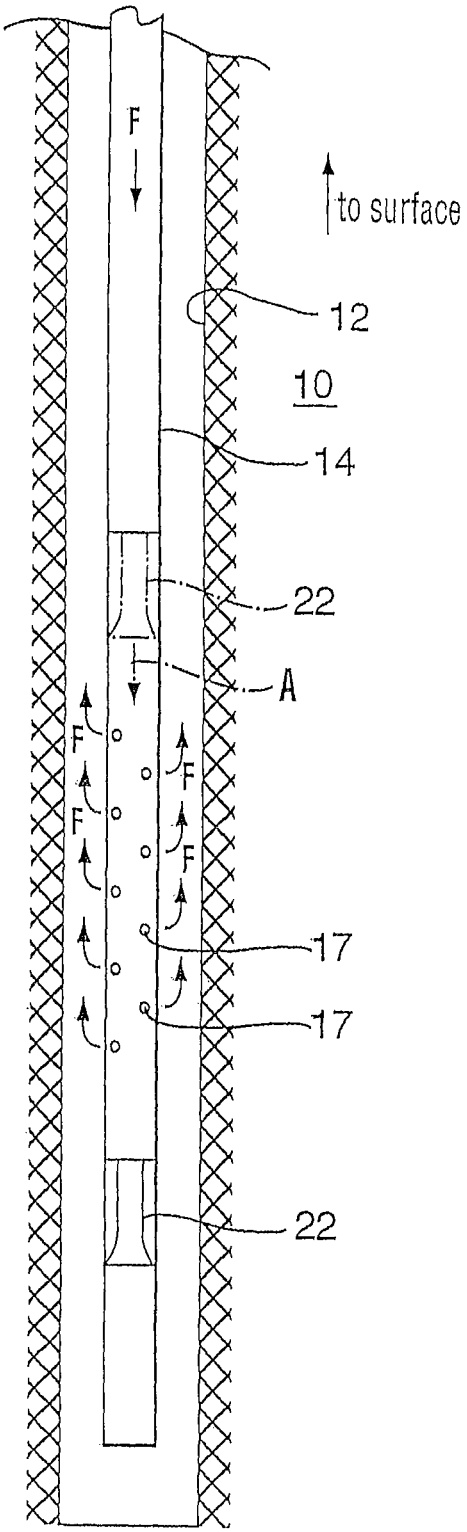
FIG. 1 is a sectional view through a wellbore having positioned therein a fluid treatment assembly according to the present invention.

Referring to FIG. 1, a wellbore fluid treatment assembly is shown, which can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ports 17 opened through the tubing string wall to permit access between the tubing string inner bore 18 and the wellbore. Each port 17 includes thereover a closure that can be closed to substantially prevent, and selectively opened to permit, fluid flow through the ports.

A port-opening sleeve 22 is disposed in the tubing string to control the opening of the port closures. In this embodiment, sleeve 22 is mounted such that it can move, arrow A, from a port closed position, wherein the sleeve is shown in phantom, axially through the tubing string inner bore past the ports to a open port position, shown in solid lines, to open the associated closures of the ports allowing fluid flow therethrough. The sliding sleeve is disposed to control the opening of the ports through the tubing string and is moveable from a closed port position to a position wherein the ports have been opened by passing of the sleeve and fluid flow of, for example, stimulation fluid is permitted down through the tubing string, arrows F, through the ports of the ported interval. If fluid flow is continued, the fluid can return to surface through the annulus.

The tubing string is deployed into the borehole in the closed port position and can be positioned down hole with the ports at a desired location to effect fluid treatment of the borehole.

Figure 2:
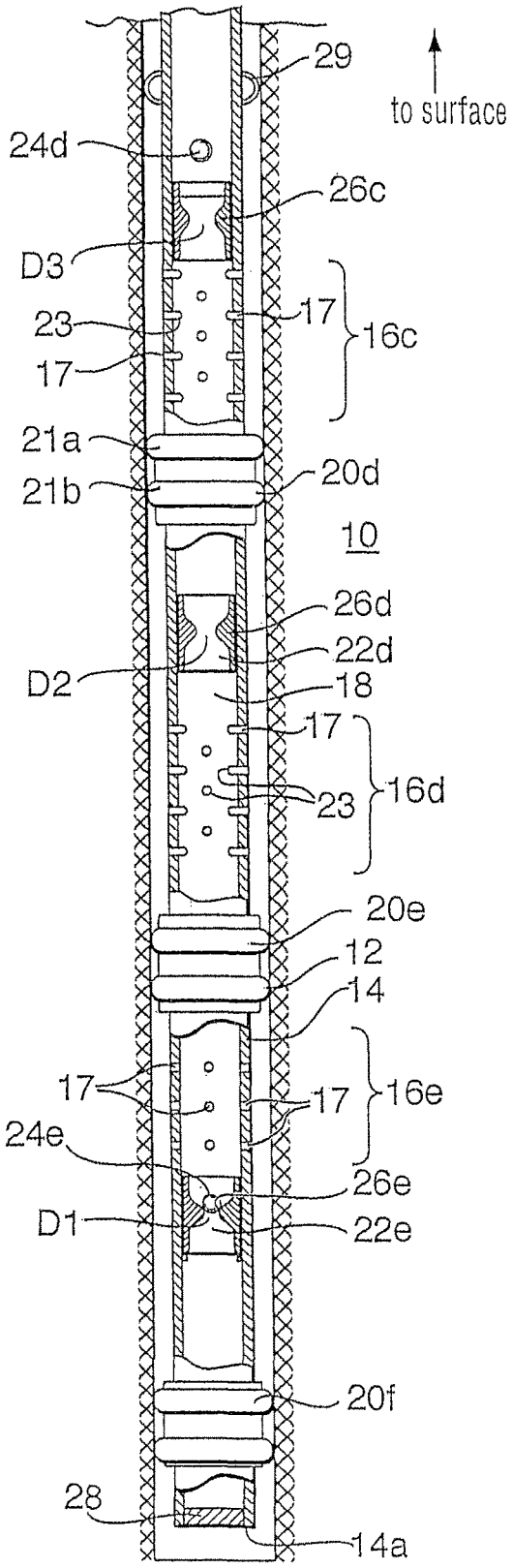
FIG. 2 is a sectional view through a wellbore having positioned therein a fluid treatment assembly according to the present invention.

Referring to FIG. 2, a wellbore fluid treatment assembly is shown, which can be used to effect fluid treatment of a formation 10 through a wellbore 12. The wellbore assembly includes a tubing string 14 having a lower end 14*a* and an upper end extending to surface (not shown). Tubing string 14 includes a plurality of spaced apart ported intervals 16*c* to 16*e* each including a plurality of ports 17 opened through the tubing string wall to permit access between the tubing string inner bore 18 and the wellbore. The ports are normally closed by pressure holding caps 23.

Packers 20*d* to 20*e* are mounted between each pair of adjacent ported intervals. In the illustrated embodiment, a packer 20*f* is also mounted below the lower most ported interval 16*e* and lower end 14*a* of the tubing string. Although not shown herein, a packer can be positioned above the upper most ported interval. The packers are disposed about the tubing string and selected to seal the annulus between the tubing string and the wellbore wall, when the assembly is disposed in the wellbore. The packers divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, packer 20*f* need not be present in some applications.

The packers can be, as shown, of the solid body-type with at least one extrudable packing element, for example, formed of rubber. Solid body packers including multiple, spaced apart packing elements 21*a*, 21*b* on a single packer are particularly useful especially for example in open hole (unlined wellbore) operations. In another embodiment, a plurality of packers are positioned in side by side relation on the tubing string, rather than using only one packer between each ported interval.

Sliding sleeves 22*c* to 22*e* are disposed in the tubing string to control the opening of the ports by opening the caps. In this embodiment, a sliding sleeve is mounted for each ported interval and can be moved axially through the tubing string inner bore to open the caps of its interval. In particular, the sliding sleeves are disposed to control the opening of their ported intervals through the tubing string and are each moveable from a closed port position away from the ports of the ported interval (as shown by sleeves 22*c* and 22*d*) to a position wherein it has moved past the ports to break open the caps and wherein fluid flow of, for example, stimulation fluid is permitted through the ports of the ported interval (as shown by sleeve 22*e*).

The assembly is run in and positioned downhole with the sliding sleeves each in their closed port position. When the tubing string is ready for use in fluid treatment of the wellbore, the sleeves are moved to their port open positions. The sleeves for each isolated interval between adjacent packers can be opened individually to permit fluid flow to one wellbore segment at a time, in a staged treatment process.

Preferably, the sliding sleeves are each moveable remotely, for example without having to run in a line or string for manipulation thereof, from their closed port position to their position permitting through-port fluid flow. In one embodiment, the sliding sleeves are actuated by devices, such as balls 24*d*, 24*e* (as shown) or plugs, which can be conveyed by gravity or fluid flow through the tubing string. The device engages against the sleeve and causes it to move4 through the tubing string. In this case, ball 24*e* is sized so that it cannot pass through sleeve 22*e* and is engaged in it when pressure is applied through the tubing string inner bore 18 from surface, ball 24*e* seats against and plugs fluid flow past the sleeve. Thus, when fluid pressure is applied after the ball has seated in the sleeve, a pressure differential is created above and below the sleeve which drives the sleeve toward the lower pressure side.

In the illustrated embodiment, the inner surface of each sleeve, which is the side open to the inner bore of the tubing string, defines a seat 26*e* onto which an associated ball 24*e*, when launched from surface, can land and seal thereagainst. When the ball seals against the sleeve seat and pressure is applied or increased from surface, a pressure differential is set up which causes the sliding sleeve on which the ball has landed to slide through the tubing string to an port-open position until it is stopped by, for example, a no go. When the ports of the ported interval 16*e* are opened, fluid can flow therethrough to the annulus between the tubing string and the wellbore and thereafter into contact with formation 10.

Each of the plurality of sliding sleeves has a different diameter seat and, therefore, each accept a different sized ball. In particular, the lower-most sliding sleeve 22*e* has the smallest diameter D1 seat and accepts the smallest sized ball 24*e* and each sleeve that is progressively closer to surface has a larger seat. For example, as shown in FIG. 1*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to open it ports first by first launching the smallest ball 24*e*, which can pass though all of the seats of the sleeves closer to surface but which will land in and seal against seat 26*e* of sleeve 22*e*. Likewise, penultimate sleeve 22*d* can be actuated to move through ported interval 16*d* by launching a ball 24*d* which is sized to pass through all of the seats closer to surface, including seat 26*c*, but which will land in and seal against seat 26*d*.

Lower end 14*a* of the tubing string can be open, closed or fitted in various ways, depending on the operational characteristics of the tubing string which are desired. In the illustrated embodiment, the tubing string includes a pump out plug assembly 28. Pump out plug assembly 28 acts to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. As will be appreciated, an opening adjacent end 14*a* is only needed where pressure, as opposed to gravity, is needed to convey the first ball to land in the lower-most sleeve. Alternately, the lower most sleeve can be hydraulically actuated, including a fluid actuated piston secured by shear pins, so that the sleeve can be driven along the tubing string remotely without the need to land a ball or plug therein.

In other embodiments, not shown, end 14*a* can be left open or can be closed, for example, by installation of a welded or threaded plug.

While the illustrated tubing string includes three ported intervals, it is to be understood that any number of ported intervals could be used. In a fluid treatment assembly desired to be used for staged fluid treatment, at least two openable ports from the tubing string inner bore to the wellbore must be provided such as at least two ported intervals or an openable end and one ported interval. It is also to be understood that any number of ports can be used in each interval.

Centralizer 29 and other tubing string attachments can be used, as desired.

The wellbore fluid treatment apparatus, as described with respect to FIG. 2, can be used in the fluid treatment of a wellbore. For selectively treating formation 10 through wellbore 12, the above-described assembly is run into the borehole and the packers are set to seal the annulus at each location creating a plurality of isolated annulus zones. Fluids can then pumped down the tubing string and into a selected zone of the annulus, such as by increasing the pressure to pump out plug assembly 28. Alternately, a plurality of open ports or an open end can be provided or lower most sleeve can include a piston face for hydraulic actuation thereof. Once that selected zone is treated, as desired, ball 24*e* or another sealing plug is launched from surface and conveyed by gravity or fluid pressure to seal against seat 26*e* of the lower most sliding sleeve 22*e*, this seals off the tubing string below sleeve 22*e* and drives the sleeve to open the ports of ported interval 16*e* to allow the next annulus zone, the zone between packer 20*e* and 20*f*, to be treated with fluid. The treating fluids will be diverted through the ports of interval 16*e* whose caps have been removed by moving the sliding sleeve. The fluid can then be directed to a specific area of the formation. Ball 24*e* is sized to pass though all of the seats closer to surface, including seats 26*c*, 26*d*, without sealing thereagainst. When the fluid treatment through ports 16*e* is complete, a ball 24*d* is launched, which is sized to pass through all of the seats, including seat 26*c* closer to surface, and to seat in and move sleeve 22*d*. This opens the ports of ported interval 16*d* and permits fluid treatment of the annulus between packers 20*d* and 20*e*. This process of launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough.

The apparatus is particularly useful for stimulation of a formation, using stimulation fluids, such as for example, acid, gelled acid, gelled water, gelled oil, $CO_2$, nitrogen and/or proppant laden fluids.

Figure 3:
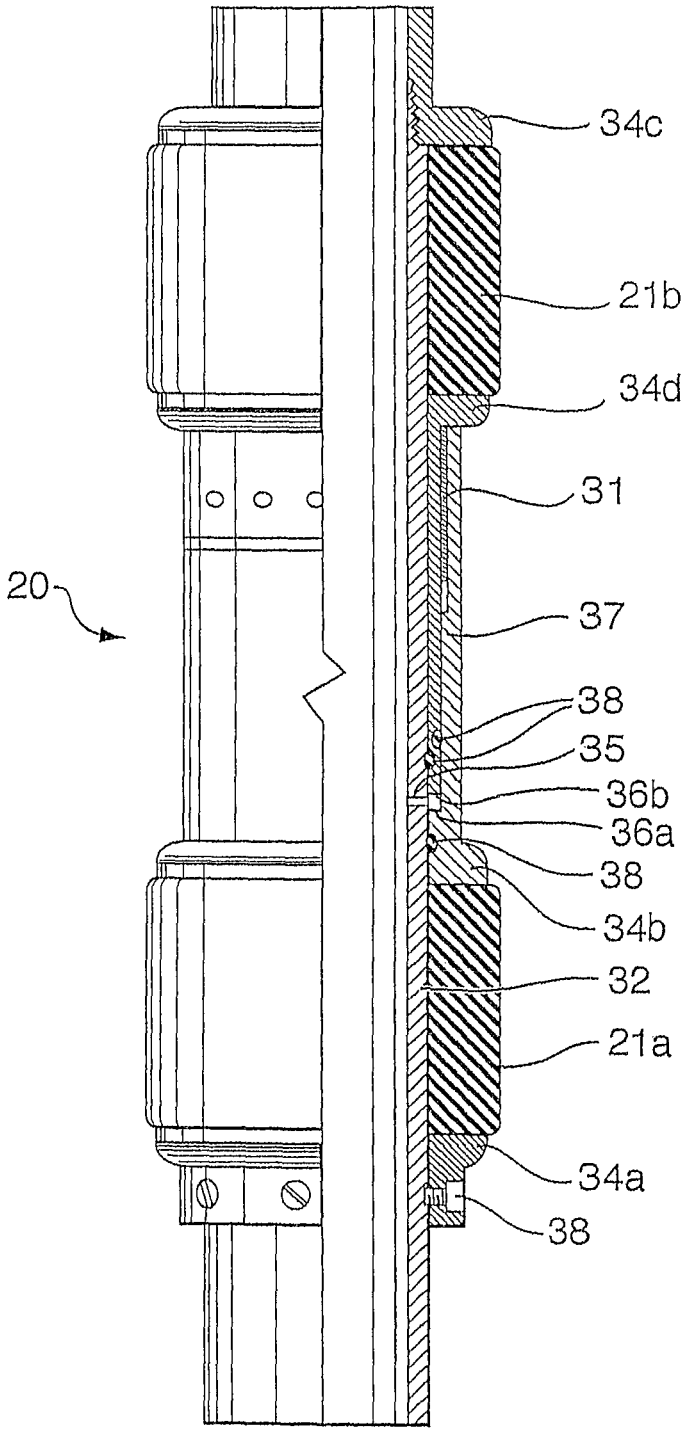
FIG. 3 is a sectional view along the long axis of a packer useful in the present invention.

Referring to FIG. 3, a packer 20 is shown which is useful in the present invention. The packer can be set using pressure or mechanical forces. Packer 20 includes extrudable packing elements 21*a*, 21*b*, a hydraulically actuated setting mechanism and a mechanical body lock system 31 including a locking ratchet arrangement. These parts are mounted on an inner mandrel 32. Multiple packing elements 21*a*, 21*b* are formed of elastomer, such as for example, rubber and include an enlarged cross section to provide excellent expansion ratios to set in oversized holes. The multiple packing elements 21*a*, 21*b* can be separated by at least 0.3M and preferably 0.8M or more. This arrangement of packing elements aid in providing high pressure sealing in an open borehole, as the elements load into each other to provide additional pack-off.

Packing element 21*a* is mounted between fixed stop ring 34*a* and compressing ring 34*b* and packing element 21*b* is mounted between fixed stop ring 34*c* and compressing ring 34*d*. The hydraulically actuated setting mechanism includes a port 35 through inner mandrel 32, which provides fluid access to a hydraulic chamber defined by first piston 36*a* and second piston 36*b*. First piston 36*a* acts against compressing ring 34*b* to drive compression and, therefore, expansion of packing element 21*a*, while second piston 36*b* acts against compressing ring 34*d* to drive compression and, therefore, expansion of packing element 21*b*. First piston 36*a* includes a skirt 37, which encloses the hydraulic chamber between the pistons and is telescopically disposed to ride over piston 36*b*. Seals 38 seal against the leakage of fluid between the parts. Mechanical body lock system 31, including for example a ratchet system, acts between skirt 37 and piston 36*b* permitting movement therebetween driving pistons 36*a*, 36*b* away from each other but locking against reverse movement of the pistons toward each other, thereby locking the packing elements into a compressed, expanded configuration.

Thus, the packer is set by pressuring up the tubing string such that fluid enters the hydraulic chamber and acts against pistons 36*a*, 36*b* to drive them apart, thereby compressing the packing elements and extruding them outwardly. This movement is permitted by body lock system 31. However, body lock system 31 locks the packers against retraction to lock the packing elements in their extruded conditions.

Ring 34*a* includes shears 38 which mount the ring to mandrel 32. Thus, for release of the packing elements from sealing position the tubing string into which mandrel 32 is connected, can be pulled up to release shears 38 and, thereby, release the compressing force on the packing elements.

Figure 4A:
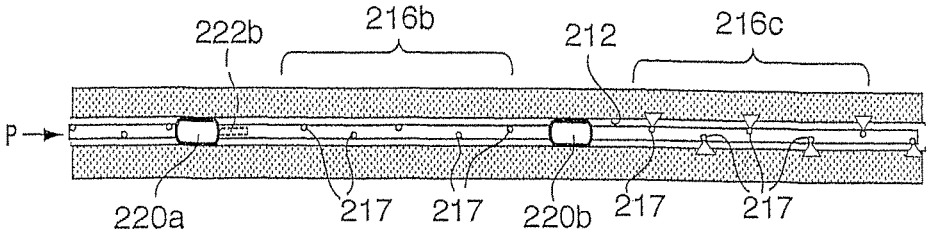
FIG. 4*a* is a section through another wellbore having positioned therein another fluid treatment assembly according to the present invention, the fluid treatment assembly being in a first stage of wellbore treatment.
Figure 4B:
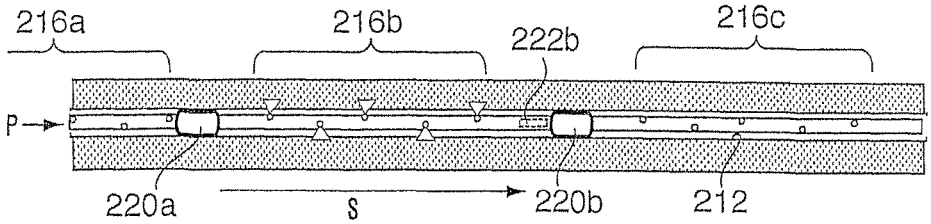
FIG. 4*b* is a section through the wellbore of FIG. 4*a* with the fluid treatment assembly in a second stage of wellbore treatment.
Figure 4C:
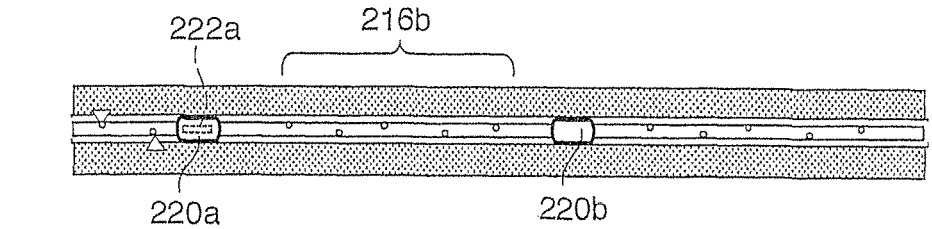
FIG. 4*c* is a section through the wellbore of FIG. 4*a* with the fluid treatment assembly in a third stage of wellbore treatment.

FIGS. 4*a* to 4*c* shows an assembly and method for fluid treatment, termed sprinkling, wherein fluid supplied to an isolated interval is introduced in a distributed, low pressure fashion along an extended length of that interval. The assembly includes a tubing string 212 and ported intervals 216*a*, 216*b*, 216*c* each including a plurality of ports 217 spaced along the long axis of the tubing string. Packers 220*a*, 220*b* are provided between each interval to form an isolated, segment in the wellbore 212.

While the ports of interval 216*c* are open during run in of the tubing string, the ports of intervals 216*b* and 216*a*, are closed during run in and sleeves 222*a* and 222*b* are mounted within the tubing string and actuatable to selectively open the ports of intervals 216*a* and 216*b*, respectively. In particular, in FIG. 4*a*, the position of sleeve 222*b* is shown when the ports of interval 216*b* are closed. The ports in any of the intervals can be size restricted to create a selected pressure drop therethrough, permitting distribution of fluid along the entire ported interval.

Once the tubing string is run into the well, stage 1 is initiated wherein stimulation fluids are pumped into the end section of the well to ported interval 216*c* to begin the stimulation treatment (FIG. 4*a*). Fluids will be forced to the lower section of the well below packer 220*b*. In this illustrated embodiment, the ports of interval 216*c* are normally open size restricted ports, which do not require opening for stimulation fluids to be jetted therethrough. However, it is to be understood that the ports can be installed in closed configuration, but opened once the tubing is in place.

When desired to stimulate another section of the well (FIG. 4*b*), a ball or plug (not shown) is pumped by fluid pressure, arrow P, down the well and will seat in a selected sleeve 222*b* sized to accept the ball or plug. The pressure of the fluid behind the ball will push the cutter sleeve against any force or member, such as a shear pin, holding the sleeve in position and down the tubing string, arrow S. As it moves down, it will open the ports of interval 216*b* as it passes by them. Sleeve 222*b* eventually stops against a stop means. Since fluid pressure will hold the ball in the sleeve, this effectively shuts off the lower segment of the well including previously treated interval 216*c*. Treating fluids will then be forced through the newly opened ports. Using limited entry or a flow regulator, a tubing to annulus pressure drop insures distribution. The fluid will be isolated to treat the formation between packers 220*a* and 220*b*.

After the desired volume of stimulation fluids are pumped, a slightly larger second ball or plug is injected into the tubing and pumped down the well, and will seat in sleeve 222*a* which is selected to retain the larger ball or plug. The force of the moving fluid will push sleeve 222*a* down the tubing string and as it moves down, it will open the ports in interval 216*a*. Once the sleeve reaches a desired depth as shown in FIG. 4*c*, it will be stopped, effectively shutting off the lower segment of the well including previously treated intervals 216*b* and 216*c*. This process can be repeated a number of times until most or all of the wellbore is treated in stages, using a sprinkler approach over each individual section.

The above noted method can also be used for wellbore circulation to circulate existing wellbore fluids (drilling mud for example) out of a wellbore and to replace that fluid with another fluid. In such a method, a staged approach need not be used, but the sleeve can be used to open ports along the length of the tubing string. In addition, packers need not be used when the apparatus is intended for wellbore circulation as it is often desirable to circulate the fluids to surface through the wellbore annulus.

The sleeves 222*a* and 222*b* can be formed in various ways to cooperate with ports 217 to open those ports as they pass through the tubing string.

Figure 5:
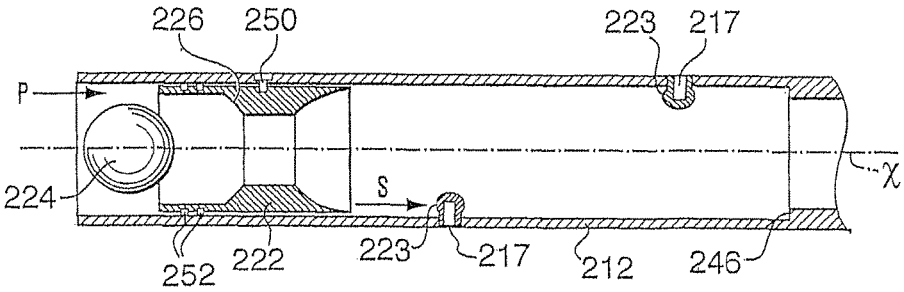
FIG. 5 is a sectional view along the long axis of a tubing string according to the present invention containing a sleeve and axially spaced fluid treatment ports.

With reference to FIG. 5, a tubing string 214 according to the present invention is shown including a movable sleeve 222 and a plurality of normally closed ports 217 spaced along the long axis x of the string. Ports 217 each include a pressure holding, internal cap 223. Cap 223 extends into the bore 218 of the tubing string and is formed of shearable material at least at its base, so that it can be sheared off to open the port. Cap 223 can be, for example, a cobe sub or other modified subs. As will be appreciated, due to the use of ball actuated sleeves, the caps are selected to be resistant to shearing by movement of a ball therepast.

Sleeve 222 is mounted in the tubing string and includes a cylindrical outer surface having a diameter to substantially conform to the inner diameter of, but capable of sliding through, the section of the tubing string in which the sleeve is selected to act. Sleeve 222 is mounted in tubing string by use of a shear pin 250 and has a seat 226 formed on its inner facing surface with a seat diameter to be plugged by a selected size ball 224 having a diameter greater than the seat diameter. When the ball is seated in the seat, and fluid pressure is applied therebehind, arrow P, shear pin 250 will shear and the sleeve will be driven, with the ball seated therein along the length of the tubing string until stopped by shoulder 246.

Sleeve 222 includes a profiled leading end 247 which is formed to shear or cut off the protective caps 223 from the ports as it passes, thereby opening the ports. Sleeve 222 and caps 223 are selected with consideration as to the fluid pressures to be used to substantially ensure that the sleeve can shear the caps from and move past the ports as it is driven through the tubing string.

While shoulder 246 is illustrated as an annular step on the inner diameter of the tubing string, it is to be understood that any configuration that stops movement of the sleeve though the wellbore can be used. Shoulder 246 is preferably spaced from the ports 217 with consideration as to the length of sleeve 222 such that when the sleeve is stopped against the shoulder, the sleeve does not cover any ports. Although not shown, the sleeve can be disposed in a circumferential groove in the tubing string, the groove having a diameter greater than the id of the tubing string. In such an embodiment, the sleeve could be disposed in the groove to eliminate or limit its extension into the tubing string inner diameter.

Sleeve 222 can include seals 252 to seal between the interface of the sleeve and the tubing string, where it is desired to seal off fluid flow therebetween.

The caps can also be used to close off ports disposed in a plane orthogonal to the long axis of the tubing string, if desired.

Figure 6:
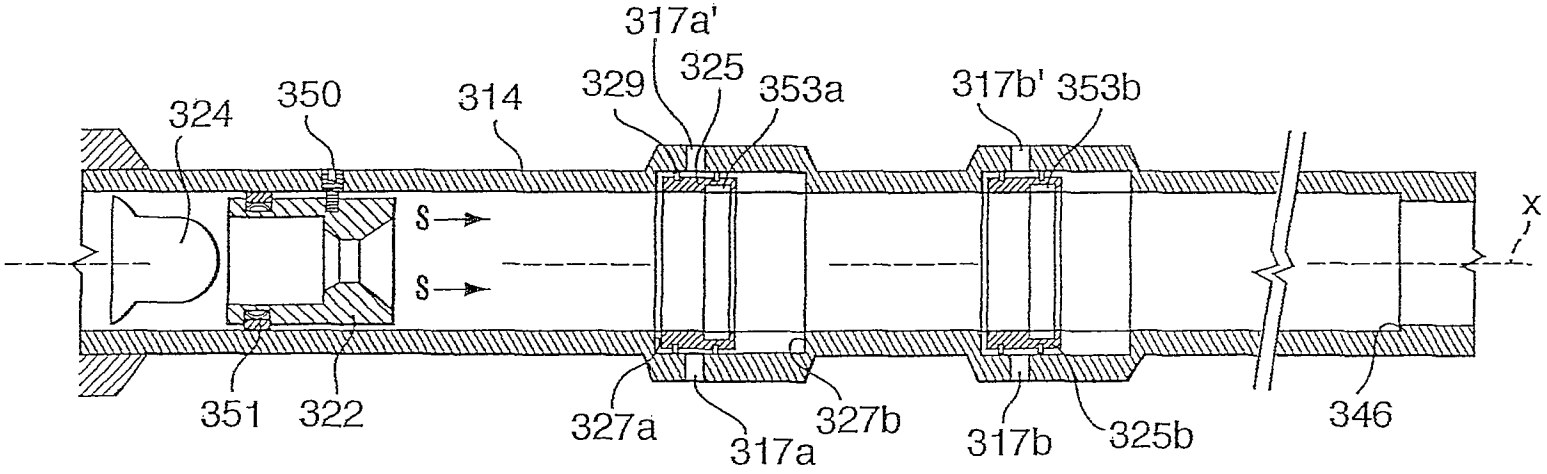
FIG. 6 is a sectional view along the long axis of a tubing string according to the present invention containing a sleeve and axially spaced fluid treatment ports.
Figure 7A:
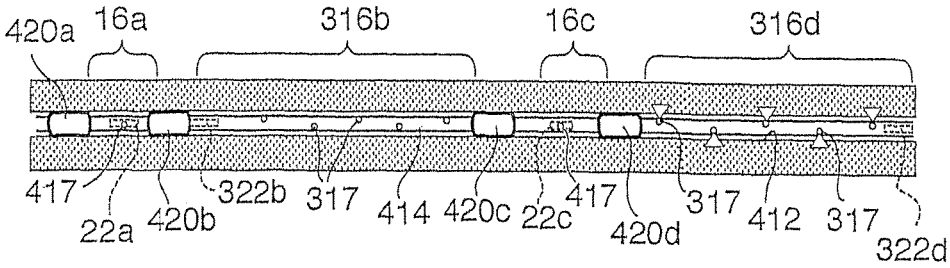
FIG. 7*a* is a section through a wellbore having positioned therein another fluid treatment assembly according to the present invention, the fluid treatment assembly being in a first stage of wellbore treatment.
Figure 7B:
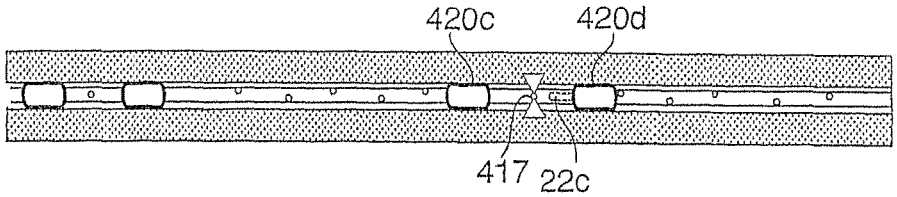
FIG. 7*b* is a section through the wellbore of FIG. 7*a* with the fluid treatment assembly in a second stage of wellbore treatment.
Figure 7C:
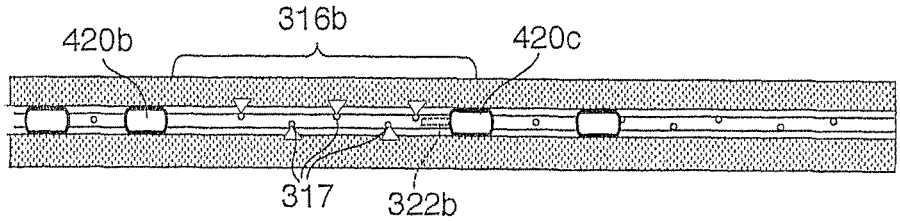
FIG. 7*c* is a section through the wellbore of FIG. 7*a* with the fluid treatment assembly in a third stage of wellbore treatment.
Figure 7D:
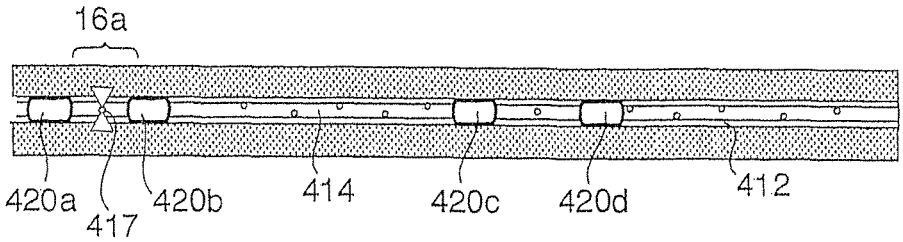
FIG. 7*d* is a section through the wellbore of FIG. 7*a* with the fluid treatment assembly in a fourth stage of wellbore treatment.

Referring to FIG. 6, there is shown another tubing string 314 according to the present invention. The tubing string includes an axially movable sleeve 322 and a plurality of normally closed ports 317*a*, 317*a*', 317*b*, 317*b*'. Ports 317*a*, 317*a*' are spaced from each other on the tubing circumference. Ports 317*b*, 317*b*' are also spaced circumferentially in a plane orthogonal to the long axis of the tubing string. Ports 317*a*, 317*a*' are spaced from ports 317*b*, 317*b*' along the long axis x of the string.

Sleeve 322 is normally mounted by shear 350 in the tubing string. However, fluid pressure created by seating of a plug 324 in the sleeve, can cause the shear to be sheared and the sleeve to be driven along the tubing string until it butts against a shoulder 346.

Ports 317*a*, 317*a*' have positioned thereover a port-closing sleeve 325*a* and ports 317*b*, 317*b*' have positioned thereover a port closing sleeve 325*b*. The sleeves act as valves to seal against fluid flow though their associated ports, when they are positioned thereover. However, sleeves 325*a*, 325*b* can be moved axially along the tubing string to exposed their associated ports, permitting fluid flow therethrough. In particular, with reference to ports 317*a*, 317*a*', each set of ports includes an associated sliding sleeve disposed in a cylindrical groove, defined by shoulders 327*a*, 327*b* about the port. The groove is formed in the inner wall of the tubing string and sleeve 325*a* is selected to have an inner diameter that is generally equal to the tubing string inner diameter and an outer diameter that substantially conforms to, but is slidable along, the groove between shoulders 327*a*, 327*b*. Seals 329 are provided between sleeve 325*a* and the groove, such that fluid leakage therebetween is substantially avoided.

The port closing sleeves, for example 325*a*, are normally positioned over their associated ports 317*a*, 317*a*' adjacent shoulder 327*a*, but can be slid along the groove until stopped by shoulder 327*b*. In each ease, the shoulder 327*b* is spaced from its ports with consideration as to the length of the associated sleeve so that when the sleeve is butted against shoulder 327*b*, the port is open to allow at least some fluid flow therethrough.

The port-closing sleeves 325*a*, 325*b* are each formed to be engaged and moved by sleeve 322 as it passes through the tubing string from its pinned position to its position against shoulder 346. In the illustrated embodiments, sleeves 325*a*, 325*b* are moved by engagement of outwardly biased dogs 351 on the sleeve 322. In particular, each sleeve 325*a*, 325*b* includes a profile 353*a*, 353*b* into which dogs 351 can releasably engage. The spring force of dogs and the co acting configurations of profiles and the dogs are together selected to be greater than the resistance of sleeve 325 moving within the groove, but less than the fluid pressure selected to be applied against ball 324, such that when sleeve 322 is driven through the tubing string, it will engage against each sleeve 325*a* to move it away from its ports 317*a*, 317*a*' and against its associated shoulder 327*b*. However, continued application of fluid pressure will drive the dogs 351 of the sleeve 322 to collapse, overcoming their spring force, to remove the sleeve from engagement with a first port-closing sleeve 325*a*, along the tubing string 314 and into engagement with the profile 353*b* of the next-port associated sleeve 325*b* to move that sleeve and open ports 317*b*, 317*b*' and so on, until sleeve 322 stopped against shoulder 346.

Referring to FIGS. 7*a* to 7*d*, the wellbore fluid treatment assemblies described above can also be combined with a series of ball activated focused approach sliding sleeves and packers as described in applicant's corresponding US Application 2003/0127227 to allow some segments of the well to be stimulated using a sprinkler approach and other segments of the well to be stimulated using a focused fracturing approach.

In this embodiment, a tubing or casing string 414 is made up with two ported intervals 316*b*, 316*d* formed of subs having a series of size restricted ports 317 therethrough and in which the ports are each covered, for example, with protective pressure holding internal caps and in which each interval includes a movable sleeve 322*b*, 322*d* with profiles that can act as a cutter to cut off the protective caps to open the ports. Other ported intervals 16*a*, 16*c* include a plurality of ports 417 disposed about a circumference of the tubing string and are closed by a ball or plug activated sliding sleeves 22*a*, 22*c*. Packers 420*a*, 420*b*, 420*c*, 420*d* are disposed between each interval to create isolated segments along the wellbore 412.

Once the system is run into the well (FIG. 7*a*), the tubing string can be pressured to set some or all of the open hole packers. When the packers are set, stimulation fluids are pumped into the end section of the tubing to begin the stimulation treatment, identified as stage 1 sprinkler treatment in the illustrated embodiment. Initially, fluids will be forced to the lower section of the well below packer 420*d*. In stage 2, shown in FIG. 7*b*, a focused frac is conducted between packers 420*c* and 420*d*; in stage 3, shown in FIG. 7*c*, a sprinkler approach is used between packers 420*b* and 420*c*; and in stage 4, shown in FIG. 7*d*, a focused frac is conducted between packers 420*a* and 420*b*.

Sections of the well that use a "sprinkler approach", intervals 316*b*, 316*d*, will be treated as follows: When desired, a ball or plug is pumped down the well, and will seat in one of the cutter sleeves 322*b*, 322*d*. The force of the moving fluid will push the cutter sleeve down the tubing string and as it moves down, it will remove the pressure holding caps from the segment of the well through which it passes. Once the cutter reaches a desired depth, it will be stopped by a no-go shoulder and the ball will remain in the sleeve effectively shutting off the lower segment of the well. Stimulation fluids are then pumped as required.

Segments of the well that use a "focused stimulation approach", intervals 16*a*, 16*c*, will be treated as follows: Another ball or plug is launched and will seat in and shift open a pressure shifted sliding sleeve 22*a*, 22*c*, and block off the lower segment(s) of the well. Stimulation fluids are directed out the ports 417 exposed for fluid flow by moving the sliding sleeve.

Fluid passing through each interval is contained by the packers 420*a* to 420*d* on either side of that interval to allow for treating only that section of the well.

The stimulation process can be continued using "sprinkler" and/or "focused" placement of fluids, depending on the segment which is opened along the tubing string.

It will be apparent that changes may be made to the illustrative embodiments, while falling within the scope of the invention and it is intended that all such changes be covered by the claims appended hereto.

The invention claimed is:

1. An apparatus for fluid treatment of a borehole, the apparatus comprising:

a tubing string having a long axis and a wall defining an inner bore, a plurality of closures accessible from the inner bore of the tubing string, each closure closing a port extending through the wall of the tubing string and preventing fluid flow through its port, but being openable to permit fluid flow through its port and each closure openable independently from each other closure, and a port-opening sleeve positioned in the tubing string and driveable by a plug through the tubing string to actuate the plurality of closures to open the ports.

2. The apparatus of claim 1 wherein at least one of the plurality of closures includes a cap extending into the tubing string inner bore, the cap being openable by movement therepast of the port-opening sleeve.

3. The apparatus of claim 2 wherein the cap is opened by engagement thereagainst by the port-opening sleeve has engaged against and opened the cap.

4. The apparatus of claim 3 wherein cap is shearable by the port-opening sleeve.

5. The apparatus of claim 1 wherein at least one of the plurality of closures includes a port-closure sleeve covering its port, the port-closure sleeve being moveable to expose its port by engagement of port-opening sleeve to move the port-closure sleeve along the tubing string.

6. The apparatus of claim 5 wherein the port-closure sleeve includes a profile and the port-opening sleeve includes a locking dog biased outwardly therefrom and selected to lock into the profile on the port-closure sleeve.

7. The apparatus of claim 1 wherein the port-opening sleeve is driveable by plugging the sleeve with a sealing device and applying fluid pressure to move the sleeve.

8. The apparatus of claim 7 wherein the sealing device can seal against fluid passage past the port-opening sleeve.

9. The apparatus of claim 7 wherein the port-opening sleeve has formed thereon a seat and the sealing device is a plug.

10. The apparatus of claim 7 wherein the port-opening sleeve has formed thereon a seat and the sealing device is a ball selected to seal against the seat.

11. The apparatus of claim 1 further comprising a packer disposed about the tubing string.

12. The apparatus of claim 11 wherein the packer is a solid body packer including multiple packing elements.

13. The apparatus of claim 12 wherein the multiple packing elements are spaced apart.

14. A method for fluid treatment of a borehole, the method comprising:

providing an apparatus for wellbore treatment including a tubing string having a long axis and a wall defining an inner bore, a plurality of closures accessible from the inner bore of the tubing string, each closure closing a port extending through the wall of the tubing string and preventing fluid flow through its port, but being openable to permit fluid flow through its port and each closure openable independently from each other closure, and a port-opening sleeve positioned in the tubing string and driveable by a plug through the tubing string to actuate the plurality of closures to open the ports through the tubing string to actuate the plurality of closures to open the ports, running the tubing string into a wellbore to a position for treating the wellbore;

moving the port-opening sleeve to open the closures of the ports and continuing fluid flow to force wellbore treatment fluid out through the ports.

15. The method of claim 14, further comprising circulating the wellbore treatment fluid to surface.

16. The method of claim 14, further comprising isolating the wellbore treatment fluid to zone in the wellbore.

17. The method of claim 14 wherein the step of moving the sleeve is conducted remotely.

18. The method of claim 17 wherein the sleeve includes a seat and the step of moving the sleeve includes deploying a sealing device to plug against the seat to create a pressure differential to drive the sleeve along the tubing string.

19. The method of claim 14 wherein the step of moving the port-opening sleeve to open the closures of the ports includes shearing caps from the ports.

20. The method of claim 14 wherein the step of moving the port-opening sleeve to open the closures of the ports includes moving port-closure sleeves from over the ports.

* * * * *